US009803341B2

(12) United States Patent
Tsukamoto

(10) Patent No.: US 9,803,341 B2
(45) Date of Patent: Oct. 31, 2017

(54) SHOVEL MANAGEMENT APPARATUS AND SHOVEL MANAGEMENT METHOD

(71) Applicant: SUMITOMO(S.H.I.) CONSTRUCTION MACHINERY CO., LTD., Tokyo (JP)

(72) Inventor: Hiroyuki Tsukamoto, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 36 days.

(21) Appl. No.: 14/590,112

(22) Filed: Jan. 6, 2015

(65) Prior Publication Data

US 2015/0112544 A1 Apr. 23, 2015

Related U.S. Application Data

(63) Continuation of application No. PCT/JP2013/068768, filed on Jul. 9, 2013.

(30) Foreign Application Priority Data

Jul. 19, 2012 (JP) ..... 2012-160910

(51) Int. Cl.
*E02F 9/26* (2006.01)
*G08C 17/02* (2006.01)
(Continued)

(52) U.S. Cl.
CPC ..... *E02F 9/267* (2013.01); *G07C 5/008* (2013.01); *G07C 5/085* (2013.01); *G07C 5/0808* (2013.01); *G07C 5/0858* (2013.01); *G08C 17/02* (2013.01)

(58) Field of Classification Search
None
See application file for complete search history.

(56) References Cited

U.S. PATENT DOCUMENTS 6,256,594 B1 * 7/2001 Yamamoto ..... G07C 5/008 701/30.4
6,349,252 B1 2/2002 Imanishi et al.
(Continued)

FOREIGN PATENT DOCUMENTS

EP 1777602 4/2007
GB 2290631 1/1996
(Continued)

OTHER PUBLICATIONS

International Search Report mailed on Aug. 6, 2013.

*Primary Examiner* — Jerrah Edwards
*Assistant Examiner* — Donald J Wallace
(74) *Attorney, Agent, or Firm* — IPUSA, PLLC

(57) ABSTRACT

A shovel management apparatus includes a temporary storing part and an abnormality information storing part. The temporary storing part temporarily stores detection information containing an operation input amount detected by an input amount detecting part of a shovel and physical amounts detected by a plurality of sensors in the shovel. The abnormality information storing part stores abnormality information. A controller performs an abnormality determination based on the detection information. The controller transfers, when an occurrence of an abnormality is determined at a first time, the detection information as the abnormality information, which is stored in a time period from a second time earlier than the first time to at least the first time, from the temporary storing part to the abnormality information storing part.

15 Claims, 18 Drawing Sheets

(51) Int. Cl.
*G07C 5/00* (2006.01)
*G07C 5/08* (2006.01)

(56) References Cited

U.S. PATENT DOCUMENTS

| | | | | |
|---|---|---|---|---|
| 2006/0031042 | A1 | 2/2006 | Ogura et al. | |
| 2010/0214094 | A1 | 8/2010 | Givens et al. | |
| 2011/0010059 | A1* | 1/2011 | Suzuki | E02F 9/24 701/50 |
| 2011/0227744 | A1 | 9/2011 | Shibata et al. | |
| 2011/0282626 | A1* | 11/2011 | Rikkola | G05B 23/0232 702/179 |

FOREIGN PATENT DOCUMENTS

| | | |
|---|---|---|
| JP | 2000-297443 | 10/2000 |
| JP | 2002-285589 | 10/2002 |
| JP | 2002-332664 | 11/2002 |
| JP | 2004-007889 | 1/2004 |
| JP | 2007-186289 | 7/2007 |
| JP | 2007-326425 | 12/2007 |
| JP | 2009-174924 | 8/2009 |
| JP | 2010-156152 | 7/2010 |
| JP | 2010-271289 | 12/2010 |

* cited by examiner

SHOVEL MANAGEMENT APPARATUS AND SHOVEL MANAGEMENT METHOD

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2013/068768 filed on Jul. 9, 2013, designating the U.S., which claims priority based on Japanese Patent Application No. 2012-160910 filed on Jul. 19, 2012. The entire contents of each of the foregoing applications are incorporated herein by reference.

BACKGROUND

Technical Field

The present invention relates to a shovel management apparatus and shovel management method.

Description of Related Art

There is suggested a method to determine an occurrence of a malfunction of a construction machine based on a detection value of a sensor mounted on the construction machine. Malfunction information is sent to a management center, and a malfunction diagnosis procedure is extracted in the management center based on a sensor that detected an abnormal value. The driver of the construction machine carries out a malfunction diagnosis according to the malfunction diagnosis procedure.

There may be a case where, even if the malfunction diagnosis procedure is provided, a cause of a malfunction cannot be identified only by the diagnosis according to the detection value of the sensor and the malfunction diagnosis procedure. Because a construction machine such as a shovel performs work by driving an attachment such as a boom or the like by a hydraulic pressure generated by an engine power while hydraulically or electrically driving an upper turning body, on which the attachment and a cabin are mounted, to turn, it is necessary to provide many sensors in the construction machine to grasp an operating condition of the shovel. Additionally, the detection values of these sensors may fluctuate largely with passage of time during a time period where work is performed by the shovel. Thus, even if it is determined that a malfunction or abnormality occurs from a detection value of a sensor at a certain time point, it is difficult to determine or assume a cause which leads to the malfunction or abnormality.

Accordingly, it is desirous to provide a shovel management apparatus and shovel management method that can allow a driver or maintenance worker to easily determine a cause of an abnormality by displaying values representing a state of each part of the shovel.

SUMMARY

According to an aspect of the present invention, there is provided a shovel management apparatus including a temporary storing part that temporarily stores detection information containing an operation input amount detected by an input amount detecting part of a shovel and physical amounts detected by a plurality of sensors in the shovel, and an abnormality information storing part that stores abnormality information. A controller performs an abnormality determination based on the detection information. The controller transfers, when an occurrence of an abnormality is determined at a first time, the detection information, which is stored in a time period from a second time earlier than the first time to at least the first time, from the temporary storing part to the abnormality information storing part as the abnormality information.

There is provided according another aspect of the present invention a shovel management method including temporarily storing detection information in a temporary storing part, the detection information containing an operation input amount detected by an input amount detecting part of a shovel and physical amounts detected by a plurality of sensors in the shovel, and performing an abnormality determination based on the detection information. The method further includes retrieving, when an occurrence of an abnormality is determined in the performing an abnormality determination, the detection information from the temporary storing part, storing the retrieved detection information in an abnormality information storing part, and displaying the detection information stored in the abnormality information storing part on a display part.

Other objects, features and advantages of the present invention will become more apparent from the following detailed description when read in conjunction with the accompanied drawings.

DETAILED DESCRIPTION

A description will now be given, with reference to the drawings, of embodiments of the present invention.

Figure 1:
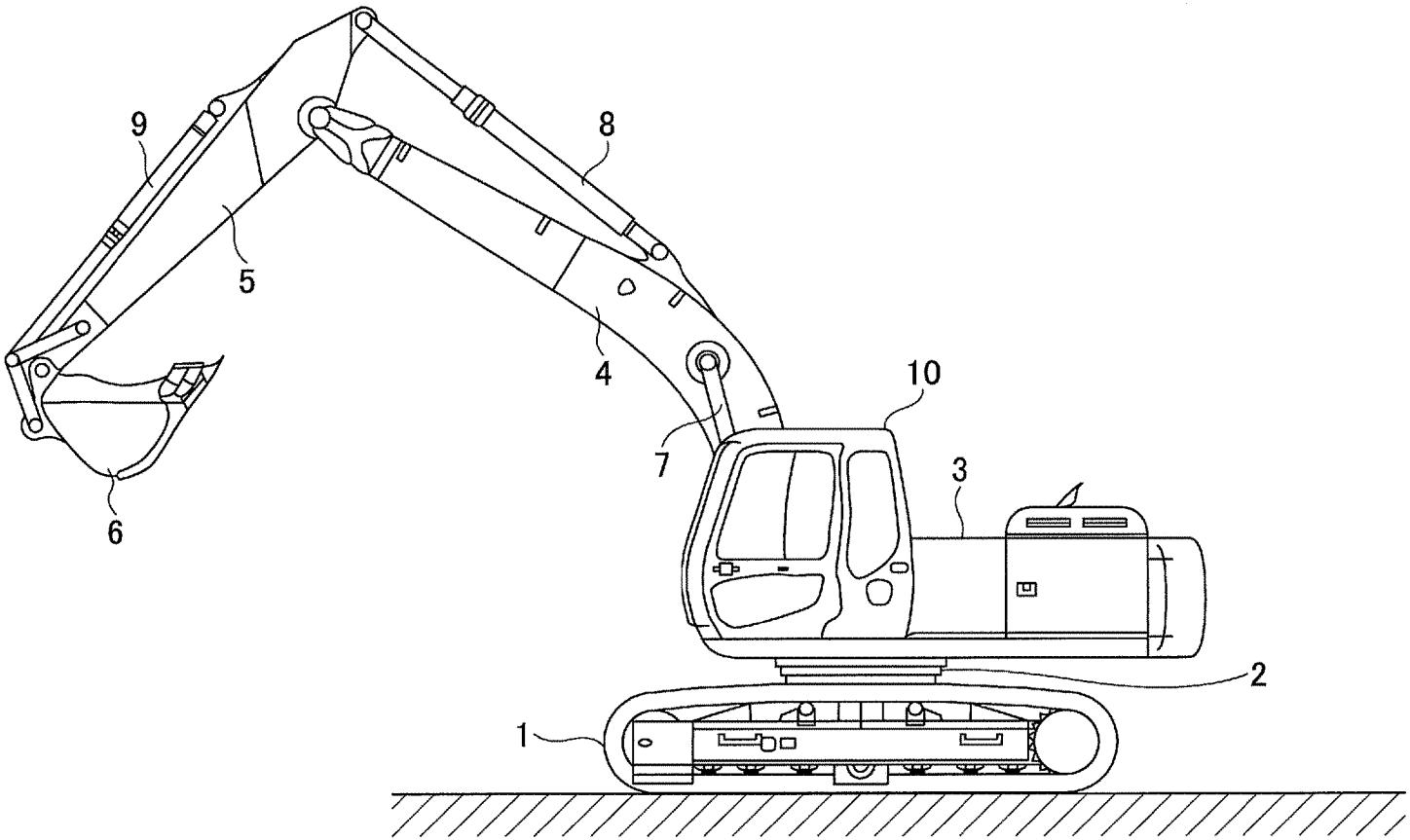
FIG. 1 is a side view of a shovel according to an embodiment of the present invention.

FIG. 1 is a side view of a shovel (excavator) according to an embodiment of the present invention. The shovel includes a lower running body 1 and an upper turning body 3 mounted on the lower running body 1 via a turning mechanism 2. A boom 4 is attached to the upper turning body 3. An arm 5 is attached to an end of the boom 4. A bucket 6 is attached to an end of the arm 5. The boom 4, arm 5 and bucket 6 are hydraulically driven by a boom cylinder 7, arm cylinder 8 and bucket cylinder 9, respectively. A cabin 10 is provided to the upper turning body 3. A power source such as an engine is also provided to the upper turning body 3. The cabin 10 is provided with a driver's seat so that a driver or operator operates the shovel while sitting on the driver's seat.

Figure 2:
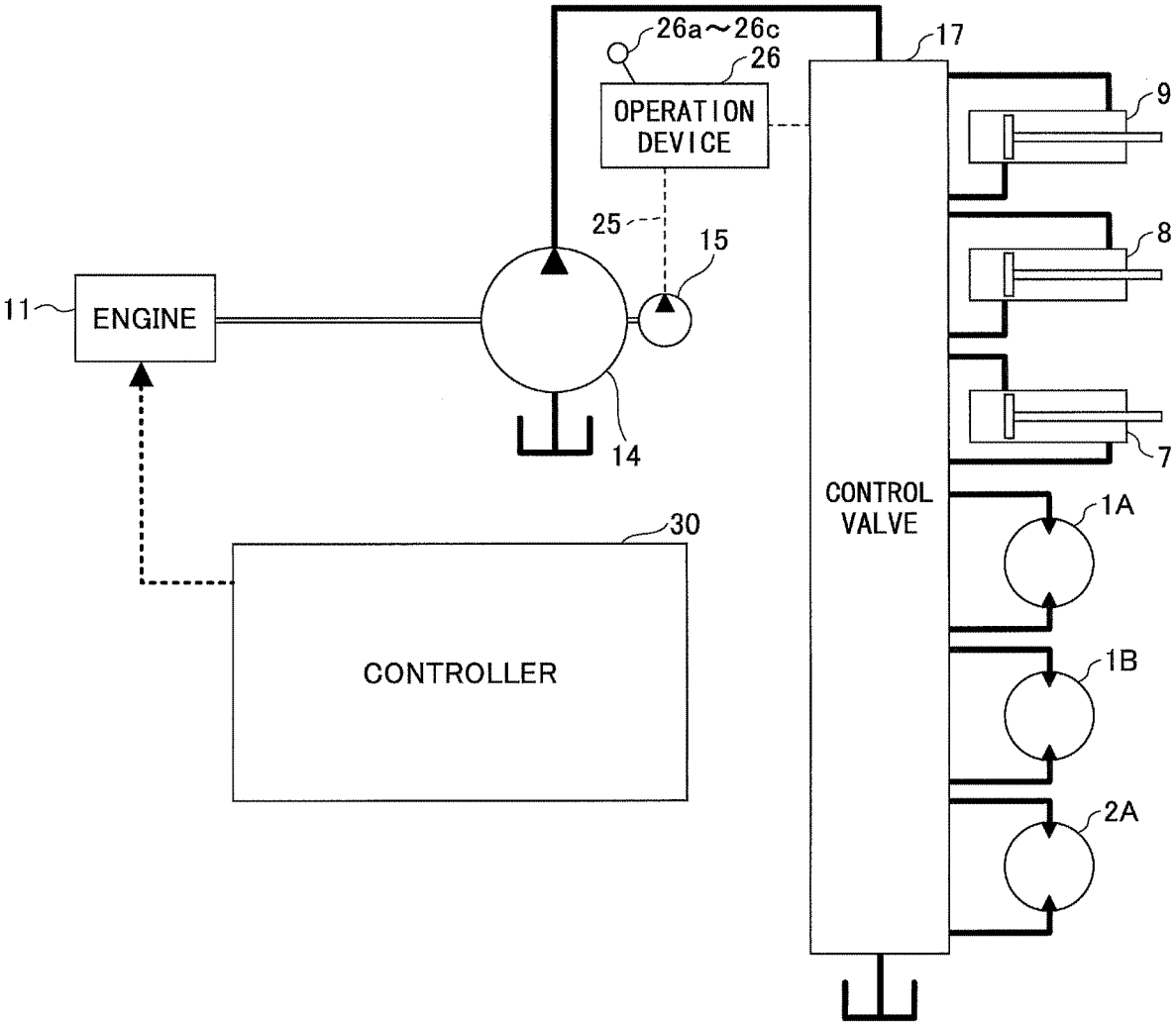
FIG. 2 is a block diagram illustrating a configuration of a drive system of the shovel illustrated in FIG. 1.

FIG. 2 is a block diagram illustrating a structure of a drive system of the shovel illustrated in FIG. 1. In FIG. 2, double lines denote a mechanical power system, bold solid lines denote high-pressure hydraulic lines, thin dashed lines denote pilot lines, and a bold dashed line arrow denotes an electric drive/control system.

The drive system of the shovel is mainly constituted by an engine 11, a main pump 14, a pilot pump 15, a control valve 17, an operation device 26 and a controller 30.

The engine 11 is a drive power source of the shovel, and is operated to maintain a predetermined number of revolutions. An output axis of the engine 11 is connected to an input axis of each of the main pump 14 and the pilot pump 15.

The main pump 14 is, for example, a swash plate type variable capacity hydraulic pump, which supplies an operating oil to the control valve 17 through a high pressure hydraulic line 16. The pilot pump 15 is, for example, a fixed capacity hydraulic pump, which supplies an operating oil to various hydraulic control devices through a pilot line 25.

The control valve 17 is a hydraulic control valve for controlling the hydraulic system in the hydraulic shovel. The control valve 17 selectively supplies the operating oil supplied from the main pump 14 to one or a plurality of the boom cylinder 7, arm cylinder 8, bucket cylinder 9, running hydraulic motor 1A (right), running hydraulic motor 1B (left) and turning hydraulic motor 2A. Note that, in the following description, the boom cylinder 7, arm cylinder 8, bucket cylinder 9, running hydraulic motor 1A (right), running hydraulic motor 1B (left) and turning hydraulic motor 2A are collectively referred to as the "hydraulic actuators".

The operation device 26 is used by an operator to operate the hydraulic actuators by supplying the operating oil supplied from the pilot pump 15 to pilot ports of the flow control valve corresponding to the respective hydraulic actuators through a pilot line 25. The pressure of the operating oil supplied to each of the pilot ports is set to a pressure responding to an operating direction and operating amount of a lever or pedal 26A-26C corresponding to a respective one of the hydraulic actuators.

The controller 30 is a control device for controlling an operating speed of each of the hydraulic actuators, which is constituted by a computer equipped with, for example, a CPU (Central Processing Unit), a RAM (Random Access Memory), a ROM (Read Only Memory), etc. The CPU of the controller 30 executes processes corresponding to programs corresponding to the operation and function of the shovel while reading the programs from the ROM and developing it on the RAM.

In the shovel having the above-mentioned structure, a management apparatus for managing an operating state of the shovel is provided. The management apparatus temporarily stores detection values from a plurality of sensors as detection information so as to send the detection information to a display device to cause the display device to display the detection information.

The display device is an input and display device constituted by, for example, a touch panel, and is arranged in the vicinity of the driver's seat and at a position where the drive can easily look. In the present embodiment, a portable information device (generally, referred to as the "portable terminal") is used as the input and display device. More specifically, a so-called smartphone, tablet terminal, etc., which is a multifunctional portable information terminal (or multifunctional portable terminal) as a portable terminal is arranged in the vicinity of the driver's seat to use as an input and display device. The management apparatus can provide information to the driver by causing the display part of the multifunctional portable information terminal to display an operating condition of the shovel and control information. Additionally, the driver can input information and instructions to the control device and management apparatus of the shovel by using an inputting function of the multifunctional portable information terminal.

In recent years, the multifunctional portable information terminal has been spread widely, and most of drivers of shovels have a multifunctional portable information terminal. Thus, by providing an attaching part such as a holder to attach a multifunctional portable information terminal at a predetermined position in the vicinity of the driver's seat, the driver of the shovel can use one's own multifunctional portable information terminal by attaching the one's own multifunctional portable information terminal to the attaching part when starting an operation of the shovel. The portable device used as an input and display apparatus of the shovel as mentioned above is not limited to one's own multifunctional portable information terminal, and may be a portable device which is previously prepared to be used for a shovel by the employer.

The attaching part for the multifunctional portable information terminal is provided with a connector for connecting the multifunctional portable information terminal to the control part of the shovel to perform data communication so that the data communication can be performed between the multifunctional portable information terminal and the control part of the shovel in a state where the multifunctional portable information terminal is attached to the attaching part. Many multifunctional portable information terminals of recent years are provided with a micro USB connector socket for connecting with an external device. Thus, by providing a micro USB connector socket in the attaching part for the multifunctional portable information terminal, the multifunctional portable information terminal can be connected to the control part of the shovel.

There are many cases where a multifunctional portable information terminal of recent years is provided with a short-distance wireless communication device using Bluetooth (Registered Trademark) or a short-distance wireless communication device using an infrared communication. Thus, the data communication between the multifunctional portable information terminal and the control part of the shovel may be performed using such a short-distance wireless communication.

Here, if the display device of the multifunctional portable information terminal is continuously used, the battery runs out for, for example, 2 to 3 hours of use. If the time of work by the shovel is longer than the battery run-out time, the multifunctional portable information terminal becomes unusable in the middle of the work. Thus, according to the present embodiment, an electric power can be supplied from the power supply part of the shovel to the multifunctional portable information terminal in a state where the multifunctional portable information terminal is attached to the attaching part.

Specifically, if, for example, the data communication is performed using the micro USB connector as mentioned above, a power supply can be performed through the micro USB connector. If the multifunctional portable information terminal has a connector exclusive for power supply, a connector connectable to such a connector may be provided to the attaching part.

By providing the attaching part for the multifunctional portable information terminal in the vicinity of the driver's seat in the cabin 10 of the shovel, the multifunctional portable information terminal can be used as a display device of the shovel by merely attaching the multifunctional portable information terminal to the attaching part.

Figure 3:
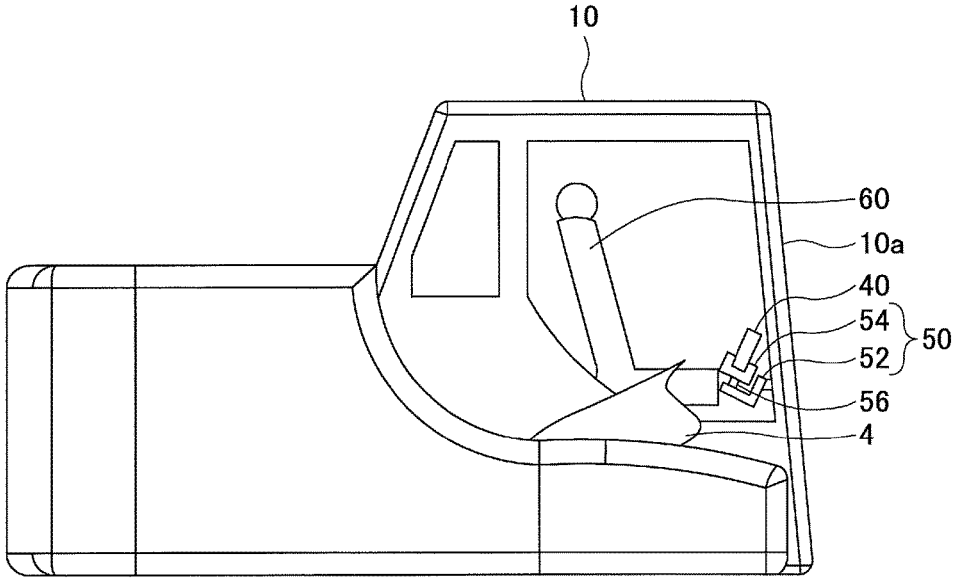
FIG. 3 is a side view of an interior of a cabin provided with an attaching part for a multifunctional portable information terminal.
Figure 4:
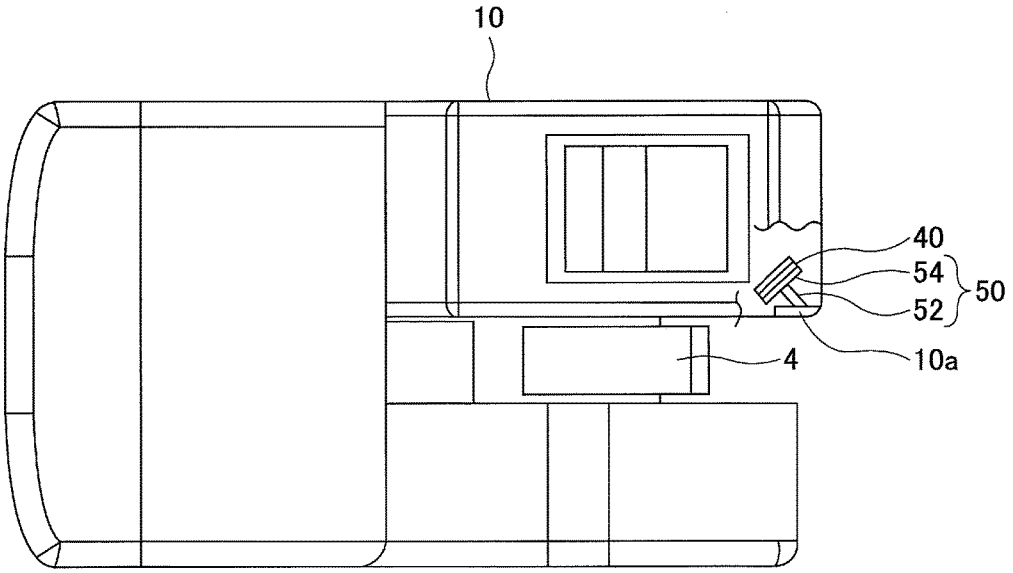
FIG. 4 is a plan view of the cabin provided with the attaching part for a multifunctional portable information terminal.

FIG. 3 is a side view of the cabin illustrating the interior of the cabin provided with the attaching part for the multifunctional portable information terminal. FIG. 4 is a plan view of the cabin provided with the attaching part for the multifunctional portable information terminal.

The attaching part 50 for attaching the multifunctional portable information terminal 40 includes an installation table 52 and a mounting part 54 supported by the installation table 52. The installation table 52 is attached and fixed to a frame 10*a* of the cabin 10 provided with the driver's seat 60. The mounting part 54 is supported by the installation table 52 via a vibration suppressing mechanism 56 including an elastic material such as a spring or soft rubber so that a vibration or shock in the cabin 10 is not directly transmitted to the mounting part 52 via the vibration suppressing mechanism 56. That is, the mounting part is supported by the installation table 52 via the vibration suppressing mechanism 56 so that a vibration or shock transmitted to the multifunctional portable information terminal fixed to the mounting part 54 is suppressed.

Generally, the boom 4 is located on the right side of the driver sitting on the driver's seat 60, and, in many cases, the driver operates the shovel while visually recognizing the bucket 6 and the arm 5 attached to the end of the boom 4. Although the frame 10*a* on the front right side of the cabin 10 is a part that blocks the view of the driver, the attaching part 40 for the multifunctional portable information terminal 40 is provided using this part in the present embodiment. Thus, because the multifunction portable information terminal 40 is located in an area that already obstructs view, the multifunction portable information terminal 40 itself cannot block the driver's view. Depending on the width of the frame 10*a*, the multifunctional portable information terminal 40 is preferably placed vertically on and fixed to the mounting part 54 so that the entire multifunctional portable information terminal 40 falls within the width of the frame 10*a*.

Note that the portable terminal (multifunctional portable information terminal 40) is used as a display device in the present embodiment, a display device such as an LCD touch panel may be previously installed the shovel.

Figure 5:
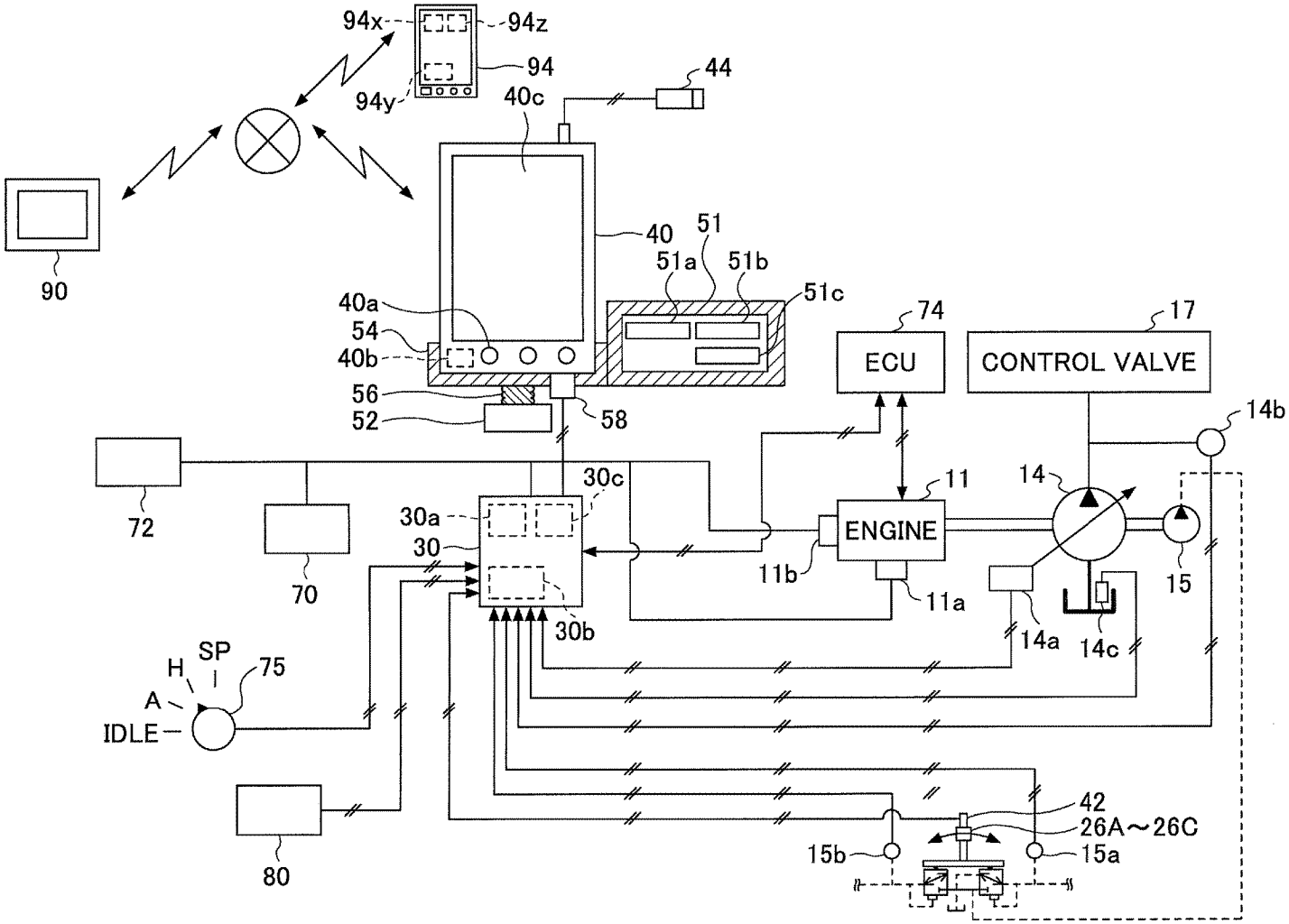
FIG. 5 is a block diagram illustrating a connection of a controller of the shovel and a multifunctional portable information terminal.

FIG. 5 is a block diagram illustrating the connection between the controller 30 (control device) of the shovel and the multifunctional portable information terminal 40. In the present embodiment, as illustrated in FIG. 5, the attaching part 50 includes a switch panel 51. The switch panel 51 is a panel including various hardware switches, and is attached to the mounting part 54. In the present embodiment, the switch panel 51 includes a light switch 51*a*, wiper switch 51*b* and window washer switch 51*c* that are hardware buttons. The light switch 51*a* is a switch for turning on/off a light attached to the exterior of the cabin 10. The wiper switch is a switch for operating/stopping a wiper. The window washer switch 51*c* is a switch for injecting a window washer liquid.

When the multifunction portable information terminal 40 is attached to the mounting part 54 of the attaching part 50, the multifunction portable information terminal 40 is connected to the controller 30 of the shovel via the connecting part 58. More specifically, a plug of a micro USB connector provided in the mounting part 54 is inserted into and connected to a receptacle (socket) of a micro USB connector of the multifunction portable information terminal 40, and, thereby, data communication can be performed between the multifunction portable information terminal 40 and the controller 30. In the present embodiment, the micro USB connector constitutes the connecting part 58.

The micro USB connector is a connector that enables an electric power supply as well as the connection for data communication. The controller 30 is driven by electric power supplied from a storage battery 70 (for example, 24 V battery) mounted to the shovel. Because the controller 30 is capable of causing an electric power to be supplied from the rechargeable battery 70 to the multifunction portable information terminal 40 via the connecting part 58, the multifunction portable information terminal 40 can be operated with the electric power supplied from the storage battery 70 of the shovel without consuming its own battery power. Moreover, the form of the connecting part 58 is not limited to a contact type such as the micro USB connector in which wires are caused to contact with each other, and may be of a non-contact type.

The storage battery 70 is charged by electric power generated by an alternator 11*a* (generator) of the engine 11. The electric power of the storage battery is supplied also to an electric component 72 of the shovel other than the controller 30. Moreover, a starter 11*b* of the engine 11 is driven by the electric power from the storage battery to start the engine 11.

The engine 11 is controlled by an engine control unit (ECU) 74. Various kinds of data indicating a state of the engine 11 (for example, data indicating a cooling water temperature (physical amount) and an engine injection pressure (physical amount)) is always transmitted from the ECU 74 to the controller 30. Accordingly, the controller 30 can store the data in a temporary storing part (memory) 30*a* to send the data to the multifunction portable information terminal 40 when it is needed.

The controller 30 is supplied with various kinds of data as mentioned below, and the data is stored in the temporary storing part 30*a*.

First, data indicating a swash plate angle is supplied to the controller 30 from a regulator 14*a* of the main pump 14, which is a variable capacity hydraulic pump. Additionally, data indicating a discharge pressure of the main pump 14 is sent to the controller 30 from a discharge pressure sensor 14*b*. These sets of data (data indicating physical amounts) are stored in the temporary storing part 30*a*. An oil temperature sensor 14*c* is provided to a tank in which the operating oil to be taken in by the main pump 14 is stored, and data indicating a temperature of the operating oil in the tank is supplied to the controller 30 from the oil temperature sensor 14*c*.

Moreover, a pilot pressure sent to the control valve 17 when operating the operation levers and pedal 26A to 26C is detected by hydraulic pressure sensors 15*a* and 15*b*, and data indicating the detected pilot pressure is sent to the controller 30. The data (data indicating an operation input amount) is stored in the temporary storing part 30*a* as detection information.

Moreover, in the present embodiment, as illustrated in FIG. 5, the shovel is equipped with an engine revolution number adjusting dial 75 in the cabin 10. The engine revolution number adjusting dial 75 is a dial for adjusting a number of revolutions of an engine, and, in the present embodiment, capable of changing the number of revolutions of the engine in four steps. Additionally, data indicating a setting state of the number of revolutions of the engine is always sent to the controller 30. The engine revolution number adjusting dial 75 can switch the number of revolutions of the engine between four steps, that is, an SP mode, an H mode, an A mode and an idling mode. Note that FIG. 5 illustrates a state where the H mode is selected by the engine revolution number adjusting dial 75.

The SP mode is a work mode that is selected when it is desirous to give a priority to an amount of work. A highest number of revolutions of the engine is used in the SP mode. The H mode is a work mode that is selected when it is desirous to achieve both a large amount of work and a low fuel consumption. A second highest number of revolutions of the engine is used in the H mode. The A mode is a work mode that is selected when it is desirous to operate the shovel with a low noise while a priority is given to a fuel consumption. A third highest number of revolutions of the engine is used in the A mode. The idling mode is a work mode that is selected when it is desirous to set the engine in an idling state. A lowest number of revolutions of the engine is used in the idling mode. The engine 11 is subjected to a revolution number control to maintain one of the numbers of revolutions of the engine, which is set by the adjusting dial 75.

Additionally, a switch 42, which is operated when a driver desires to use a voice input function of the multifunctional portable information terminal 40, is provided to the operation lever 26A. When the driver operates the switch 42, a signal is sent to the controller 30. The controller 30 sends a control signal to the multifunctional portable information terminal 40 based on the signal so as to turn on the voice input function of the multifunctional portable information terminal 40.

Thus, the driver can easily operate the switch 42 without releasing the operation lever so that the drive can input a command to the control device of the shovel using the voice input function of the multifunctional portable information terminal 40.

As a microphone for voice inputting, a microphone 40*a* incorporated in the multifunctional portable information terminal 40 can be used. That is, the driver can input a voice signal from the microphone 40*a* to a voice recognition part 40*b* of the multifunctional portable information terminal 40 by uttering a voice indicating a desired command toward the multifunctional portable information terminal 40 after operating the switch 42 provided to the operation lever. The voice recognition part 40*b* of the multifunctional portable information terminal 40 applies a voice recognition process to the voice signal input from the microphone 40*a*, and determines a command corresponding to the input voice signal. The command determined by the voice recognition part 40*b* is displayed on the display and input device 40*c* (for example, a touch panel) of the multifunctional portable information terminal 40, and is sent to the controller 30 of the shovel through the connecting part 58. As mentioned above, a command intended by the driver is input to the shovel through the voice recognition function of the multifunctional portable information terminal 40. Note that an external microphone 44 may be connected to the multifunctional portable information terminal 40, and the external microphone 44 may be arranged at a position where the driver can easily input a voice.

As mentioned above, according to the present embodiment, the detection information from the management apparatus can be displayed by using the multifunctional portable information terminal 40 as a display device of the shovel.

In the shovel having the above-mentioned structure, the control part 30*b* of the controller 30 determines whether an abnormality occurs in the shovel based on the detection information including the above-mentioned various kinds of data. Then, if the control part 30*b* of the controller 30 determines that an abnormality occurs, the control part 30*b* causes the abnormality information storing part 30*c* to transfer the detection information, which is accumulated in the temporary storing part 30*a* from time t1 to time t2, the time t1 being a predetermined time period before the time at which the determination of the occurrence of the abnormality was made, the time t2 being the time at which the determination of the occurrence of the abnormality was made.

In the above-mentioned structure, the management apparatus according to the present embodiment is constituted by the temporary storing part 30*a*, abnormality information storing part 30*c* and control part 30*b* of the controller 30. The temporary storing part 30*a* is a memory of the controller 30, and the abnormality information storing part 30*c* is also a memory inside the controller 30. A single memory may be used by dividing it for the temporary storing part 30*a* and the abnormality information storing part 30*c*. The control part 30*b* is materialized by an operation device such as the CPU or the like executing a program.

After the abnormality information stored in the temporary storing part 30*a* is stored in the abnormality information storing part 30*c*, the abnormality information stored in the abnormality information storing part 30*c* is sent to the multifunctional portable information terminal 40 as a display device according to an instruction from the control part 30*b*. Then, the abnormality information is displayed on the display part 40*c* of the multifunctional portable information terminal 40 in a previously determined pattern.

Additionally, by sending an instruction to the management apparatus, the abnormality information can be sent to and displayed on the multifunctional portable information terminal 40 (display device) at any time. For example, when a maintenance worker performs a malfunction diagnosis or repair of a shovel after an abnormality occurs in the shovel, the abnormality information can be displayed on the multifunctional portable information terminal 40 by the maintenance worker inputting an instruction to the management apparatus to display the abnormality information. The maintenance worker can check the abnormality information displayed on the multifunctional portable information terminal 40 as a display device. Then, as mentioned later, the maintenance worker can identify a cause of the abnormality by seeing the abnormality information displayed on the multifunctional portable information terminal 40 (display device).

Alternatively, the management apparatus of the shovel can cause a center management apparatus 90 installed in a remote service center to wirelessly transmit the abnormality information by using the data communication function of the multifunctional portable information terminal 40. By displaying the abnormality information on the center management apparatus 90, the maintenance worker at a remote place can determine or assume the cause of the abnormality. Accordingly, the maintenance worker can previously prepare necessary tools and parts by assuming the cause of the abnormality before going to repair the shovel. Thereby, there is no need for the maintenance worker to return to the service center to take a repair tool or place an order of parts after the maintenance worker actually visits the place where the shovel is installed, thereby reducing a time spent on the repair. In this case, the center management apparatus 90 serves as the management apparatus of the shovel.

Alternatively, upon reception of the abnormality information, the service center may transfer the abnormality information to a multifunctional portable information terminal 94 belonging to the maintenance worker of the shovel from the center management apparatus 90 through a communication network. In this case, the multifunctional portable information terminal 94 may function as the management apparatus of the shovel or a part of the management apparatus of the shovel, and may be provided with a part or all of a temporary storing part 94*x*, control part 94*y* and abnormality information storing part 94*z* corresponding to the temporary storing part 30*a*, control part 30*b* and abnormality information storing part 30*c* of the controller 30, respectively. In this case, the control part 94*y* provided in the multifunctional portable information terminal 94 causes the detection information stored in the abnormality information storing part 94*z* to be displayed on a display part 94*c*.

Note that if the portable terminal (multifunctional portable information terminal 40) is not used as a communication device, a wireless transmission device may be provided to the shovel itself so that the control part 30*b* sends the abnormality information to the remote service center by using the wireless transmission device.

A description is given below of the abnormality information displayed on the display device of the multifunctional portable information terminal 40 or the like and a method of displaying the abnormality information.

The abnormality displayed on the display device is data stored in the temporary storing part 30*a* of the management apparatus within a predetermined time period (data representing a physical amount and data representing an operation input amount). The physical amount or the operation input amount is detected (sampled) for each fixed time period, and data representing the physical amount or operation input amount is stored in the temporary storing part 30*a* together with information regarding the time at which the physical amount or operation input amount is detected. For example, the temporary storing part 30*a* is configured by a memory having a predetermined storage capacity, and, after a fixed amount of data is stored in the temporary storing part 30*a*, data detected at the earliest time is deleted and, instead, data detected at the latest time is stored in the temporary storing part 30*a*. Thus, data detected during a time period from a time, which is earlier than the latest time at which the data is detected (or the present time) by a predetermined time period, to the latest time is always stored in the temporary storing part 30*a*. Accordingly, if all data stored in the temporary storing part 30*a* is transferred to and stored in the abnormality information storing part 30*c* at time t1, data within a time period from time t2, which is earlier than time t1 by a predetermined time period, to time t1 is stored in the abnormality information storing part 30*c*.

Here, the time interval (the predetermined time period) from time t2 to time t1 is a previously set time interval, and preferably be set to, for example, a time period from about 30 seconds to about 5 minutes.

The time interval from time t2 to time t1 depends on the storage capacity of the temporary storing part 30*a*. If the storage capacity of the temporary storing part 30*a* is sufficiently large, an arbitrary time is selected for time t2 by using the time information stored together with the data so as to retrieve the data from time t2 to time t1 from the temporary storing part 30*a* and store the retrieved data in the abnormality information storing part 30*c*.

Here, time t1 is the time at which the control part 30*b* determines that an abnormality occurs based on the physical amount input from each sensor and the operation input amount. By storing data input after time t1 at which the occurrence of the abnormality is determined, the data from time t2 to time t3, which is later than time t1, may be transferred to and stored in the abnormality information storing part 30*c*.

Here, the time interval from time t1 to time t3 is a previously set time interval, and is preferably set to about 10 seconds to about 1 minute.

As mentioned above, the data as the abnormality information stored in the abnormality information storing part 30*c* is sent to the multifunctional portable information terminal 40 or the display device, or sent to the center management apparatus 90 of the remote service center, and displayed in a predetermined pattern.

Next, a description is given of a method of displaying the abnormality information. Here, a description is given of a case where the abnormality information is sent to and displayed on the multifunctional portable information terminal 94. Note that the following description is applicable to a case where the abnormality information is sent to the multifunctional portable information terminal 40 in the same manner.

Figure 6:
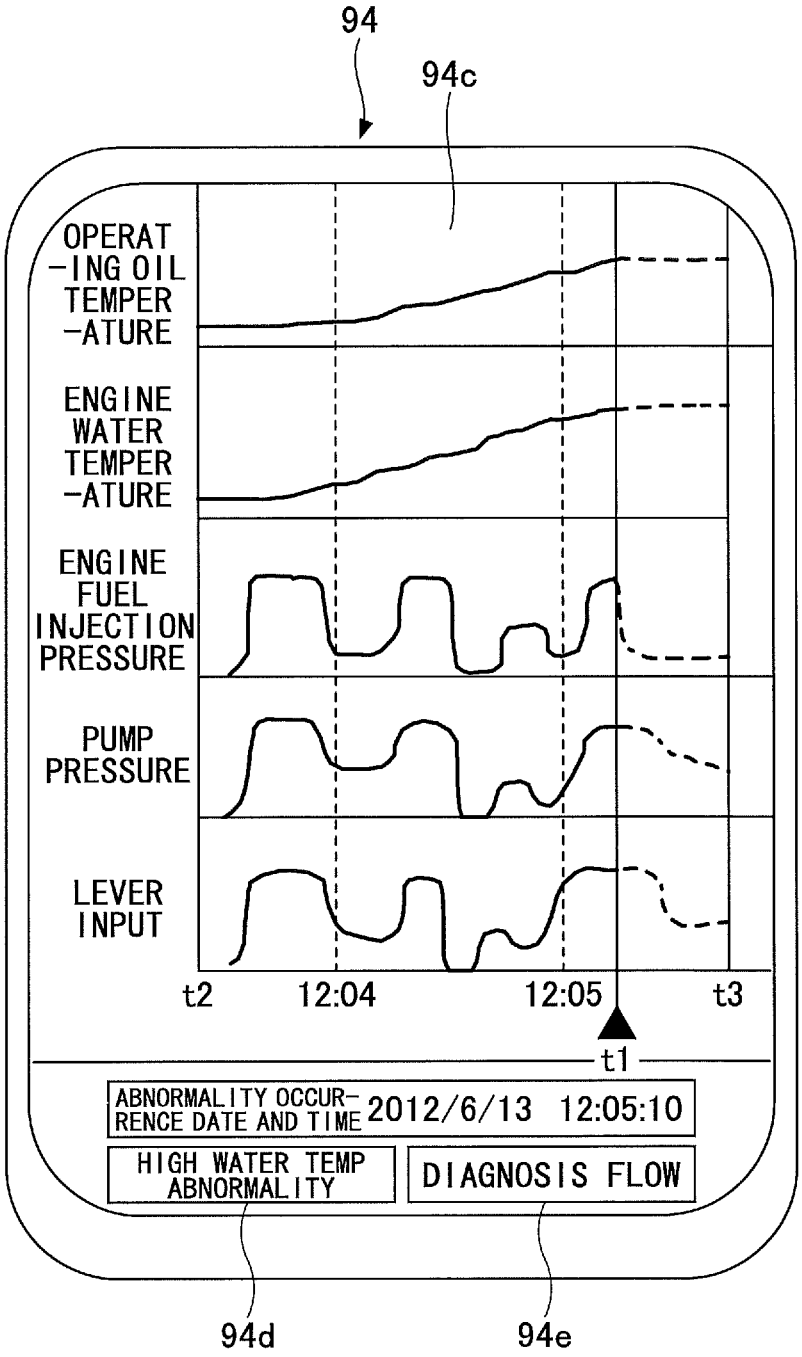
FIG. 6 is an illustration of a display part of the multifunctional portable terminal on which abnormality information is displayed.

FIG. 6 is an illustration illustrating the display part 94*c* of the multifunctional portable information terminal 94 on which the abnormality information is displayed. In the example illustrated in FIG. 6, the abnormality information includes pieces of data regarding 1) a pilot pressure (lever input) as an operation input amount detected by the hydraulic sensors 15*a* and 15*b*, 2) a pump pressure which is a hydraulic pressure (physical amount) detected by the discharge pressure sensor 14*b*, 3) an engine fuel injection pressure (physical amount) sent from the ECU 74, 4) an engine water temperature (physical amount) sent from the ECU 74, and 5) an operating oil temperature (physical amount) detected by the oil temperature sensor 14*c*, these pieces of data being displayed in vertically arranged time charts having a horizontal axis representing time.

In the example illustrated in FIG. 6, the left end of the time chart corresponds to time t2. Time t1 at which a determination is made that an abnormality occurs corresponds to a vertical line provided with a black solid triangle at the lower end side thereof. Abnormality occurrence date and time is indicated as a date and time at which the determination was made that an abnormality occurs by values of year, month, day, hour, minute and second in a blank area on the lower side of the time chart. In the example illustrated in FIG. 6, the abnormality occurrence date and time is 2012/6/13 12:05:10, and a vertical line provided with a solid black rectangle at the lower end side thereof is drawn at a position corresponding to time t1 (12:5:10) in the time chart. Additionally, an abnormality contents display part 94*d* for displaying the contents of abnormality and a diagnosis flow button 94*e* are indicated on the lower side of the abnormality occurrence date and time. In the example illustrated in FIG. 6, the abnormality contents display part 94*d* displays the "high water temperature abnormality" that indicates that the temperature of the engine cooling water becomes higher than or equal to a predetermined value. The abnormality contents may be displayed by an error code. Additionally, the diagnosis flow button is a software button for displaying a diagnosis flow screen mentioned later.

In the display of the abnormality information illustrated in FIG. 6, each data from time t2 to time t1 is indicated by the time chart. The 1) lever input (pilot pressure) fluctuates in the time period from time t2 to time t1, and it can be appreciated that the driver is operating the operation lever. The 2) pump pressure changes in response to the change in the lever input (pilot pressure), and it can be appreciated that the pump pressure is in a normal condition. The 3) engine fuel injection pressure changes in response to the lever input (pilot pressure) (that is, in response to an amount of operation of the operation lever), and it can be appreciated that the engine fuel injection pressure is in a normal condition. The 4) engine water temperature starts to rise gradually at a time which is later than time t2, and it can be appreciated that the engine water temperature reaches an abnormally high temperature at time t1. From this, it is assumed that a large load is applied to the engine and the engine water temperature is raised. The 5) operating oil temperature starts to rise gradually at a time which is later than time t2, and it can be appreciated that the engine water temperature reaches an abnormally high temperature at time t1.

In the display example illustrated in FIG. 6, because the engine water temperature exceeds an upper limit value, the control part 30*b* determines that an abnormality occurs, and, it is assumed that the abnormality information is displayed. Then, it is assumed that the operating oil temperature, engine fuel injection pressure and pump pressure other than the rising in the engine water temperature change normally. That is, the abnormality information illustrated in FIG. 6 indicates that only the engine water temperature rises excessively although an appropriate load is applied to the engine 11 because the main pump 14 driven by the engine 11 is driven normally to generate a hydraulic pressure. It is considered that such a condition is established because the cooling capacity of the cooling water of the engine is reduced and the engine 11 is not sufficiently cooled. As a cause of establishing such a condition, it is considered that a radiator and oil cooler have become dirty or a dustproof net has become dirty. Accordingly, a driver or maintenance worker who sees the display of the abnormality information illustrated in FIG. 6 first think about dirt collection of the dustproof net and performs a filter check.

Figure 7:
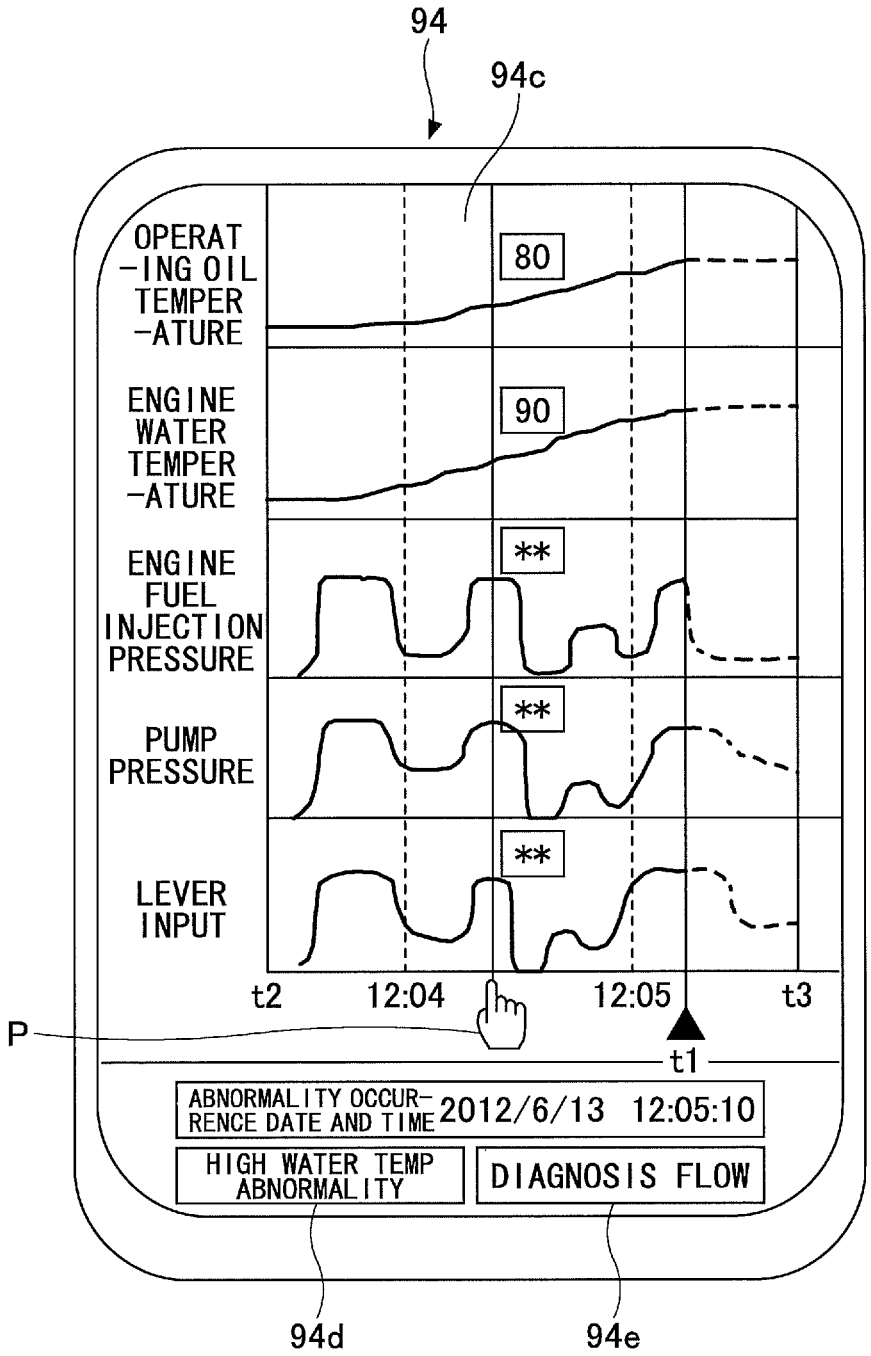
FIG. 7 is an illustration of a display screen illustrated in FIG. 6 on which detection values at an arbitrary time are displayed.

FIG. 7 is an illustration of an example of the display screen of the abnormality information illustrated in FIG. 6 in which values of the lever input (operation input amount), pump pressure (physical amount), engine fuel injection pressure (physical amount), engine water temperature (physical amount) and the operating oil temperature (physical amount) are displayed. In the display screen illustrated in FIG. 6, if an arbitrary time is designated by a pointer, a vertical line indicating the designated time appears in the time charts, and a value at that time is displayed in the vicinity of an intersection of the vertical line and the graph of each time chart. Because a pointer P appears under the vertical line, the vertical line can be moved to an arbitrary position by dragging the pointer P in a leftward or rightward direction. Thereby, the driver or maintenance worker of the shovel can immediately check the values of the lever input (operation input amount), pump pressure (physical amount), engine fuel injection pressure (physical amount), engine water temperature (physical amount) and the operating oil temperature (physical amount) at an arbitrary time within the period from time t2 to time t1.

Note that a dotted line after time t1 in each time chart is displayed when data after time t1 to time t3 is contained in the abnormality information, and the driver or maintenance worker can check changes in the values of the operation input amount and the physical amounts after time t1 by seeing the dotted lines.

Figure 8:
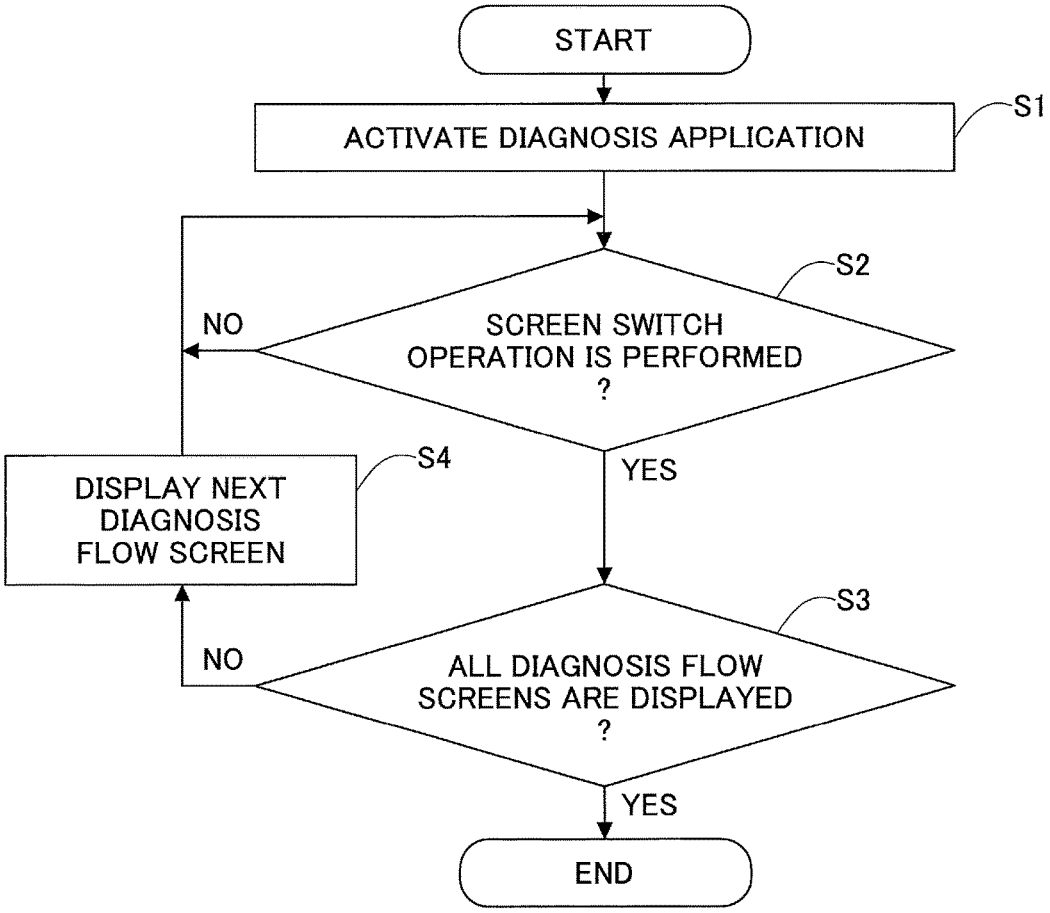
FIG. 8 is a flowchart of a diagnosis flow process.
Figure 9:
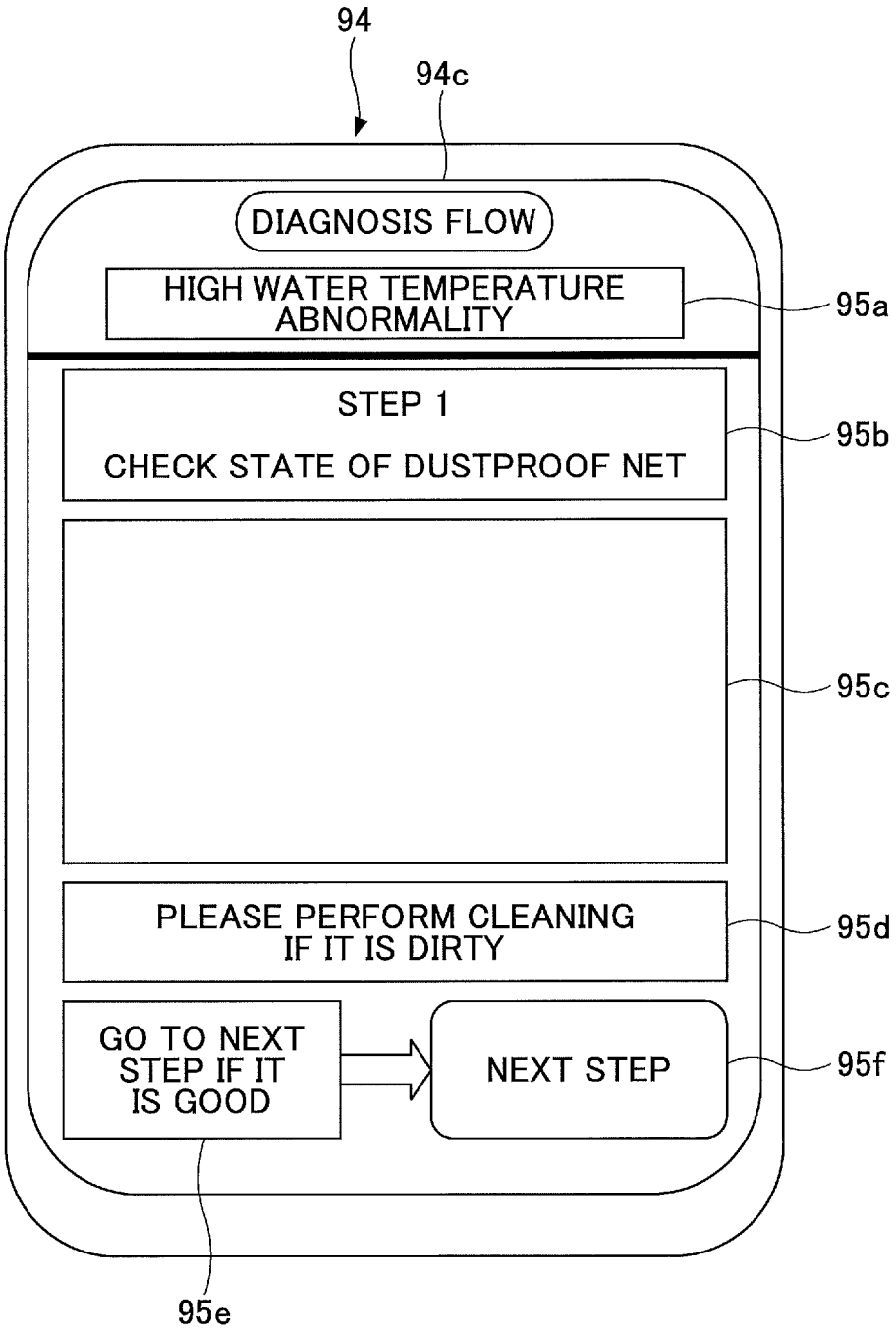
FIG. 9 is an illustration of an example of diagnosis flow screen.
Figure 10:
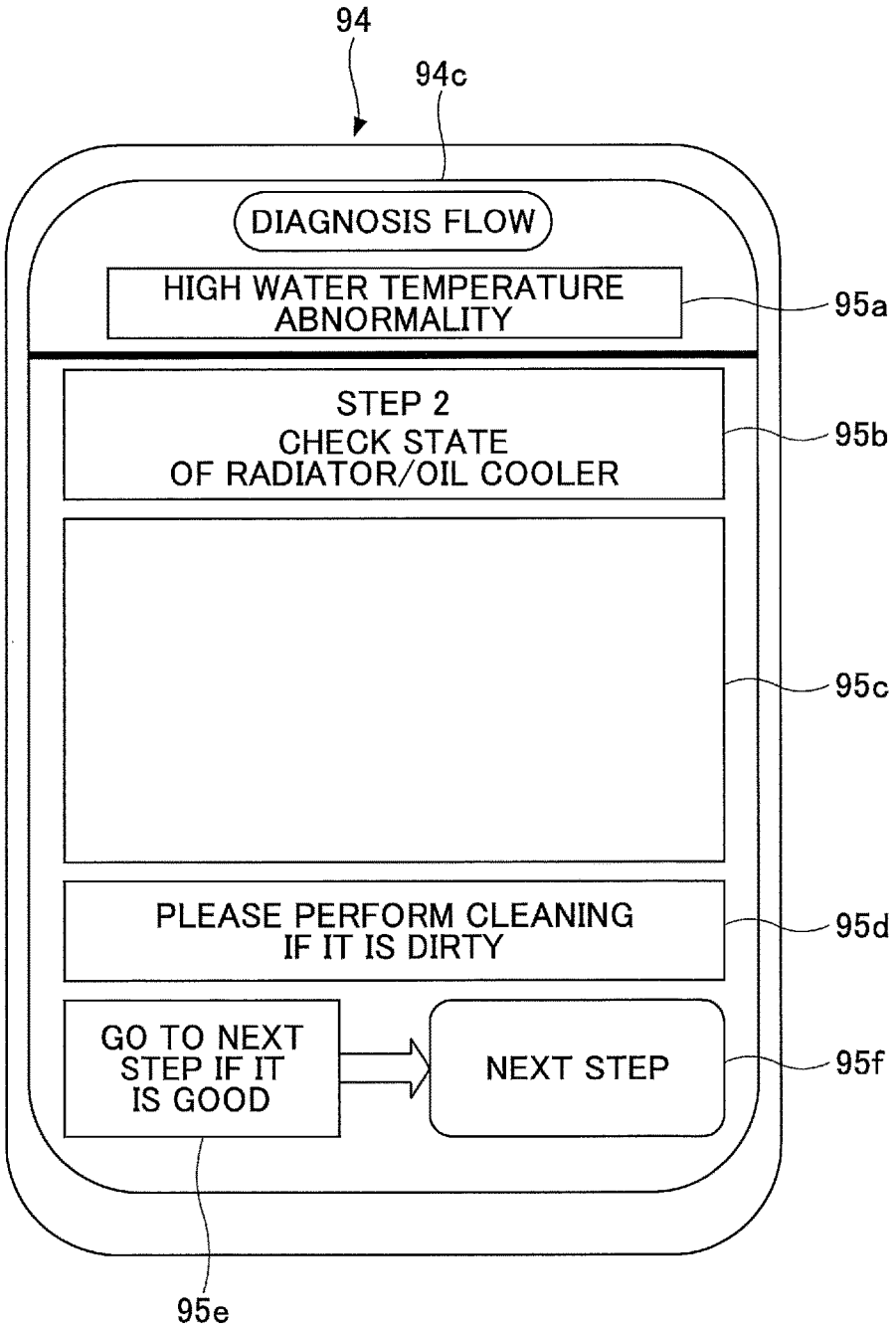
FIG. 10 is an illustration of another example of the diagnosis flow screen.
Figure 11:
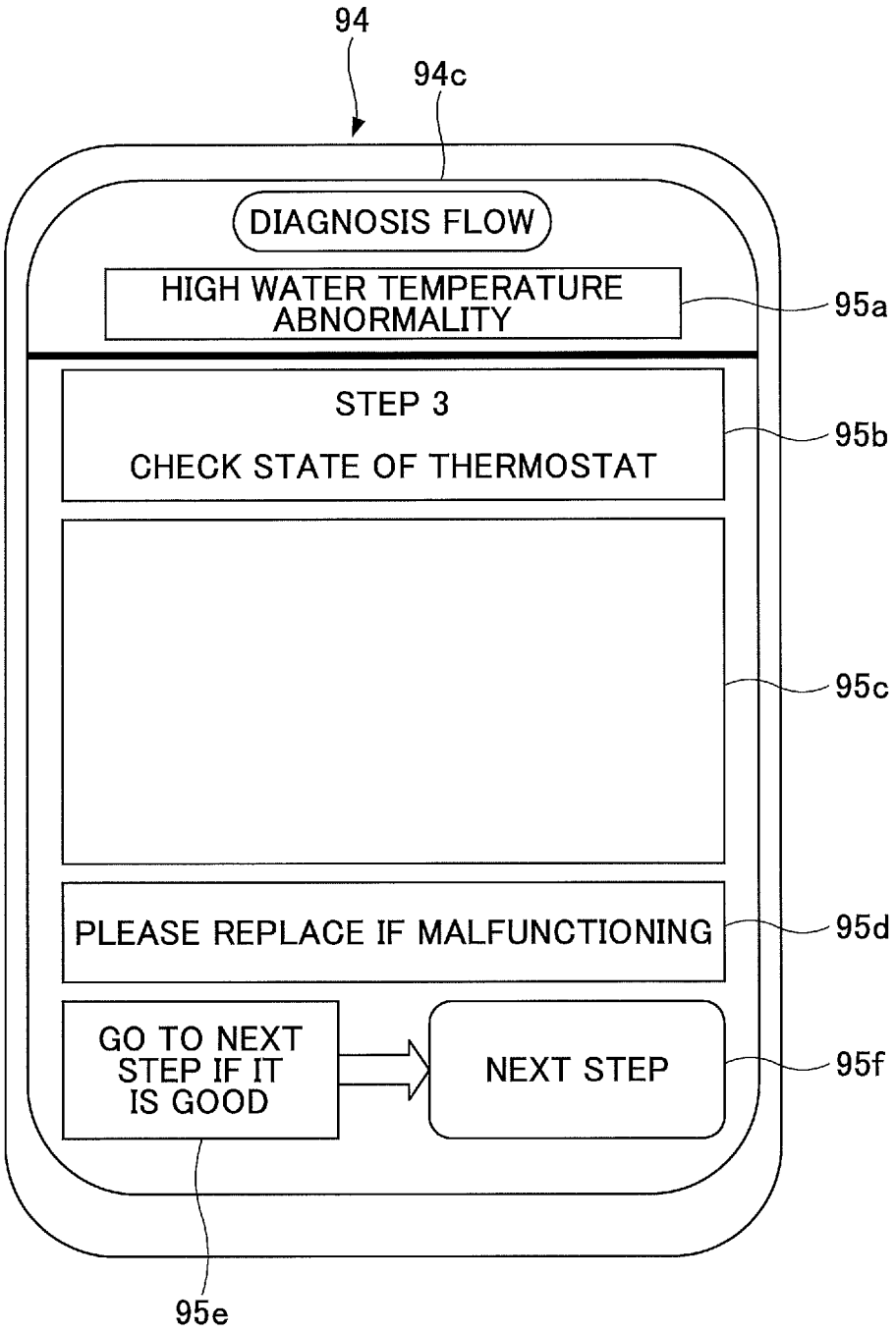
FIG. 11 is an illustration of a further example of the diagnosis flow screen.

Next, a description will be given, with reference to FIGS. 8-11, of a process performed in a case where the diagnosis flow button 94*e* is tapped (hereinafter, referred to as the "diagnosis flow process"). FIG. 8 is a flowchart of the diagnosis flow process, and the multifunctional portable information terminal 94 performs the diagnosis flow process each time the diagnosis flow button 94 is tapped. FIGS. 9-11 are illustrations illustrating examples of a diagnosis flow screen.

First, the multifunctional portable information terminal 94 activates diagnosis application software (hereinafter, referred to as the "diagnosis application") (step S1). In the present embodiment, the multifunctional portable information terminal 94 refers to a reference table in which check items corresponding to contents of each abnormality are stored in a predetermined order and displays information regarding the check items in that order.

FIG. 9 is an illustration of the diagnosis flow screen that is displayed first if the "high water temperature abnormality" is detected as the abnormality contents. The diagnosis flow screen illustrated in FIG. 9 includes an abnormality contents displaying part 95*a*, check item number displaying part 95*b*, check item position displaying part 95*c*, first message displaying part 95*d*, second message displaying part 95*e* and screen switching button 95*f*.

The abnormality contents displaying part 95*a* is an area for displaying contents of an abnormality. In the example illustrated in FIG. 9, the abnormality contents displaying part 95*a* displays the "high water temperature abnormality" indicating that the temperature of the engine cooling water becomes higher than or equal to a predetermined value.

The check item number displaying part 95*b* is an area for displaying the number of the check item presently displayed. In the example illustrated in FIG. 9, the check number displaying part 95*b* displays "step 1" indicating that it is a first check item, and also displays that the contents of step 1 is "checking the state of the dustproof net".

The check item position displaying part 95*c* is an area for illustrating a position of a component which is one of the check items, and, for example, illustratively describes the position of the dustproof net mounted on the shovel (illustration is omitted in FIG. 9). Specifically, the check item position display part 95*c* displays an illustration indicating the dustproof net on an illustration indicating an entire image of the shovel in a color different from other parts of the shovel. In this case, the operator of the multifunctional portable information terminal 94 can scroll, reduce or enlarge the illustration displayed on the check item position displaying part 95*c* by a swiping operation, pinch-in operation, pinch-out operation, etc.

The first message displaying part 95*d* and second message displaying part 95*e* are areas for displaying information regarding the check item being displayed. In the example illustrated in FIG. 9, the first message displaying part 95*d* displays the message "removal of dirt (please perform cleaning if it is dirty)" as the measures to be taken by the maintenance worker with respect to the dustproof net. Additionally, the second message displaying part 95*e* displays the message "transit to a next check item (go to next step if it is good)" as measures to be taken by the maintenance worker after checking the state of the dustproof net.

The screen switching button 95*f* is a software button for switching the screen. In the example illustrated in FIG. 9, the screen switching button 95*f* displays "next step" as a caption indicating that the button is for displaying the diagnosis flow screen regarding a next check item. The operator of the multifunctional portable information terminal 94 switches the diagnosis flow screen by tapping the screen switching button 95*f*. Note that the operator of the multifunctional portable information terminal 94 may switch the diagnosis flow screen by other operations such as a swiping operation, etc.

The description of the flow of the diagnosis flow process is continued with reference to FIG. 8.

After the diagnosis flow screen is displayed by activating the diagnosis application, the multifunctional portable information terminal 94 continuously monitors existence/non-existence of a screen switching operation (step S2). In the present embodiment, the multifunctional portable information terminal 94 determines whether the screen switching button 95*f* is tapped or whether a swiping operation is performed to switch the screen.

If it is determined that the screen switching operation is not performed (NO in step S2), the multifunctional portable information terminal 94 waits for the screen switching operation.

On the other hand, if it is determined that the screen switching operation is performed (YES in step S2), the multifunctional portable information terminal 94 determines whether all of the diagnosis flow screens have been displayed (step S3).

If it is determined that all of the diagnosis flow screens have not been displayed yet (NO in step S3), the multifunctional portable information terminal 94 displays the next diagnosis flow screen (step S4) and returns the process to step S2 to continue the monitoring of existence/non-existence of the screen switching operation.

On the other hand, if it is determined that all of the diagnosis screens have been displayed (YES in step S3), the multifunctional portable information terminal 94 ends the diagnosis flow process at this time. Note that the screen switching button 95*f* may display "end" as a caption when no other diagnosis flow screen exists. Additionally, if the end button is taped, the multifunctional portable information terminal 94 may switches the diagnosis flow screen to an initial screen (not illustrated in the figure) of the multifunctional portable information terminal 94.

FIG. 10 is an illustration of a diagnosis flow screen displayed when the screen switching button 95*f* of FIG. 9 is tapped. In the diagnosis flow screen of FIG. 10, "step 2" indicating that the display is a second check item regarding the abnormality contents "high water temperature abnormality" is displayed in the check item number displaying part 95*b*. Additionally, it displays that the contents of step 2 is "checking a state of radiator and oil cooler". The check item position displaying part 95*c* displays an illustration indicating the radiator and oil cooler on an illustration representing an image of the entire shovel in a color different from other parts (illustration is omitted in FIG. 10).

FIG. 11 is an illustration of a diagnosis flow screen displayed when the screen switching button 95*f* of FIG. 10 is tapped. In the diagnosis flow screen of FIG. 11, "step 3" indicating the third check item with respect to the abnormality contents "high water temperature abnormality" is displayed in the check item number displaying part 95*b*. Additionally, the check item number display part 95*b* displays that the contents of the step 3 is "check a state of the thermostat". The check item position displaying part 95*c* displays an illustration indicating the thermostat on an illustration indicating an image of the entire shovel in a color different from other parts (illustration is omitted in FIG. 11). The first message displaying part 95*d* displays "replacement in a case of operation failure (please replace when malfunctioning)" as measures to be taken by a maintenance worker with respect to the thermostat.

As mentioned above, the multifunctional portable information terminal 94 can present measures to be taken with respect the present abnormality contents to the operator of the multifunctional portable information terminal 94 in an easily understandable manner.

Figure 12:
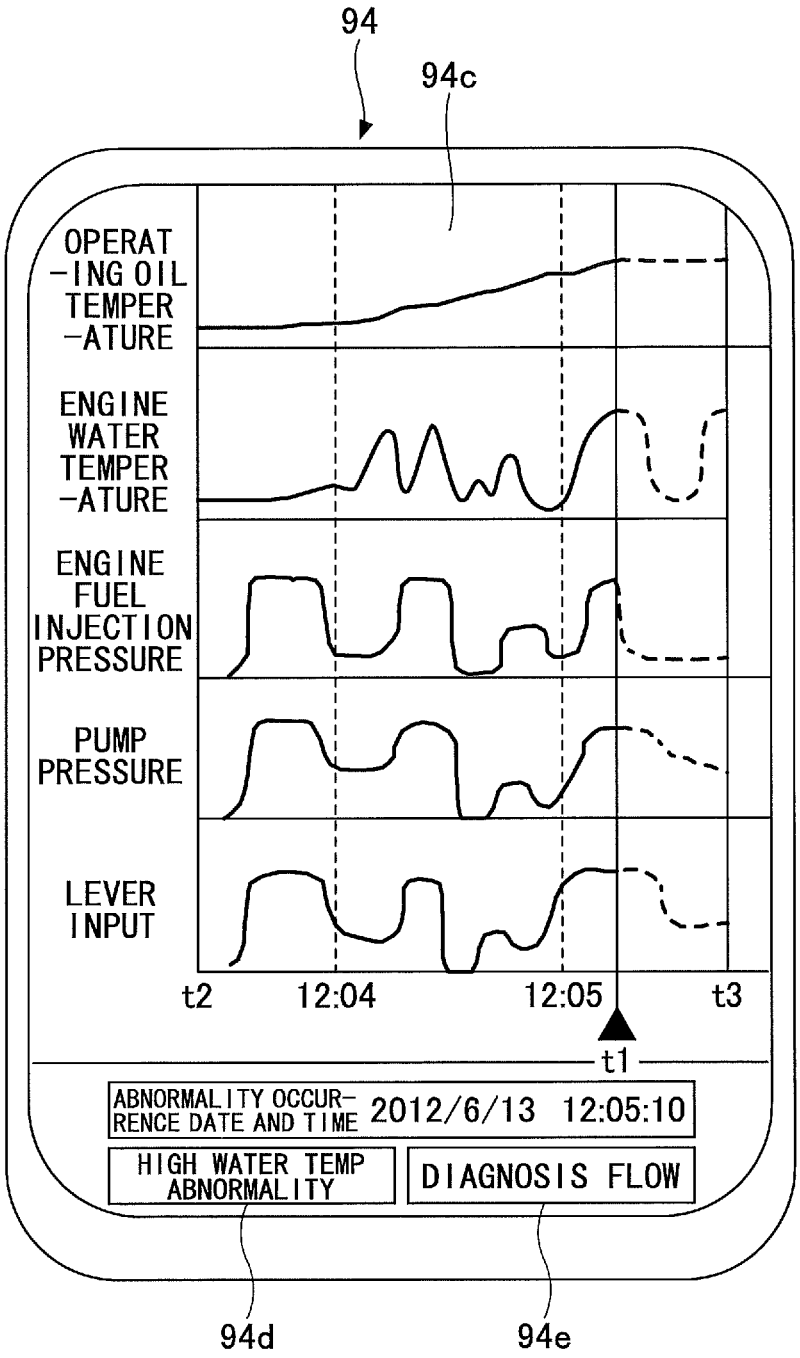
FIG. 12 is an illustration of a display part of the multifunctional portable terminal on which abnormality information is displayed.

Next, a description is given, with reference to FIG. 12, of a case where the operator of the multifunctional portable information terminal 94 can assume a cause of the abnormality contents of the shovel without performing the diagnosis flow process. FIG. 12 is an illustration illustrating the display part 94*c* of the multifunctional portable information terminal 94 on which the abnormality information is displayed, which corresponds to FIG. 6. In the example illustrated in FIG. 12, the engine water temperature starts to vibrate vertically us and down at a time passed the time 12:04, which is an unstable state of the engine water temperature. It is assumed that this is caused by a looseness in the attachment of the thermostat. Thus, the operator (maintenance worker) of the multifunctional portable information terminal 94 first thinks about a malfunction of the thermostat and performs a maintenance work (repair or the like).

Figure 13:
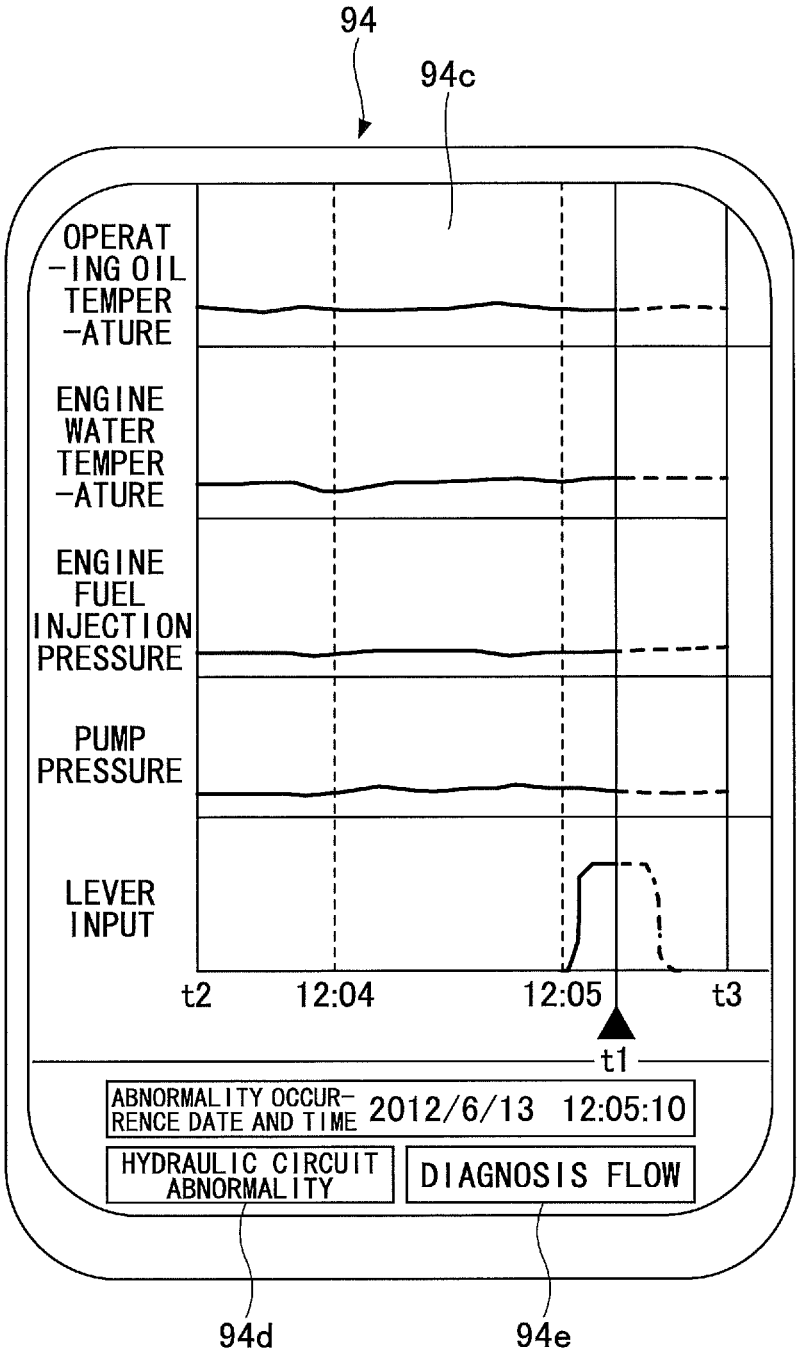
FIG. 13 is an illustration of the display part of the multifunctional portable terminal on which abnormality information is displayed.

Similarly, FIG. 13 is an illustration of the display part 94*c* of the multifunctional portable information terminal 94 on which the abnormality information is displayed, and is a display example when an abnormality different from the example illustrated in FIG. 6 occurs. In the example illustrated in FIG. 13, there are no changes in the pump pressure, engine fuel injection pressure, engine water temperature and operating oil temperature despite that the lever input rises slightly before time t1. As one of causes that lead to such a condition, it is considered that an abnormality occurs in the main pump 14. For example, if the main pump 14 cannot generate a hydraulic pressure because it is driven but runs idle, the pump pressure does not rise and a load to the engine does not rise, and, thereby, the engine fuel injection pressure and engine water pressure do not rise. Additionally, because the hydraulic pressure does not rise, the operating oil temperature also does not rise. The abnormality information illustrated in FIG. 13 represents such a condition (a condition in which the abnormality contents indicates "hydraulic circuit abnormality"). When a maintenance worker sees the display illustrated in FIG. 13, the maintenance worker can perform a maintenance work (repair, etc.) first in consideration of a malfunction of the main pump 14.

Figure 14:
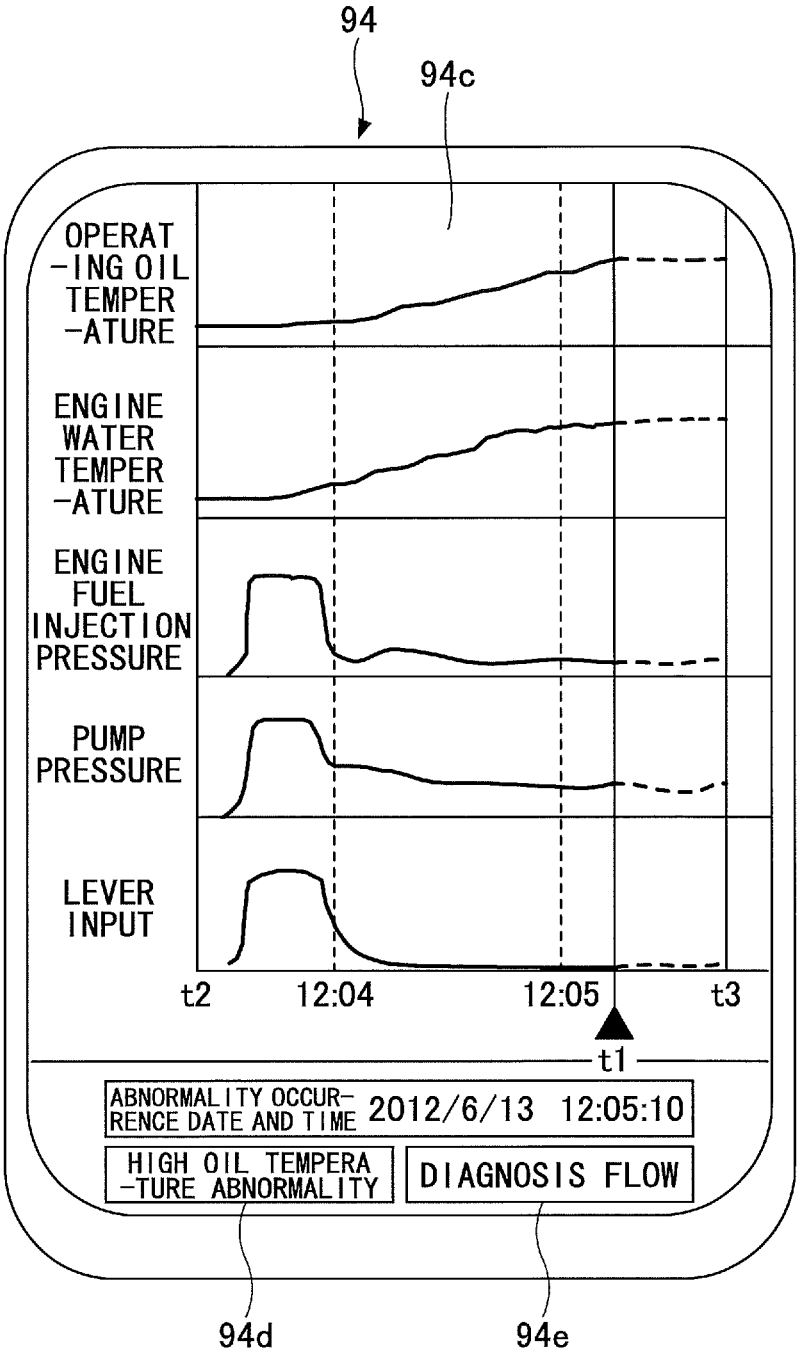
FIG. 14 is an illustration of the display part of the multifunctional portable terminal on which abnormality information is displayed.

Similarly, FIG. 14 is an illustration of the display part 94*c* of the multifunctional portable information terminal 94 on which the abnormality information is displayed, and is a display example when an abnormality different from the examples illustrated in FIGS. 6 and 13 occurs. In the example illustrated in FIG. 14, despite that the lever input is lost after it once rises immediately after time t2, the pump pressure, which is to be lost, is not lost and an absorbing horsepower by the main pump 14 is maintained higher than or equal to a predetermined value. As one of causes that lead to such a condition, it is considered that an abnormality occurs in a negative control (hereinafter, may be referred to as the "negacon"), which is an energy saving circuit. For example, if the main pump 14 malfunctions, the operating oil temperature and engine water temperature continuously rise because the main pump 14 continuously discharges the operating oil at a high flow rate. The abnormality information illustrated in FIG. 14 represents such a condition (a condition in which the abnormality contents indicates "high oil temperature abnormality"). When a maintenance worker sees the display illustrated in FIG. 14, the maintenance worker can perform a maintenance work (repair, etc.) first in consideration of a malfunction of the "negacon" (negative controller).

Note that although the pilot pressure supplied by a lever operation is used as the operation input amount in the above-mentioned embodiment, if the operation lever is of an electric type, an electric signal indicating the lever operation amount output from the operation device can be used as the operation input amount. Additionally, for example, detection values of a pump discharge amount of the main pump (or a proportional valve current), an engine revolution number sent from the ECU 74, an engine load rate, an engine boost pressure, etc., may be used as physical amounts other than the detection values illustrated in FIG. 6.

Figure 15:
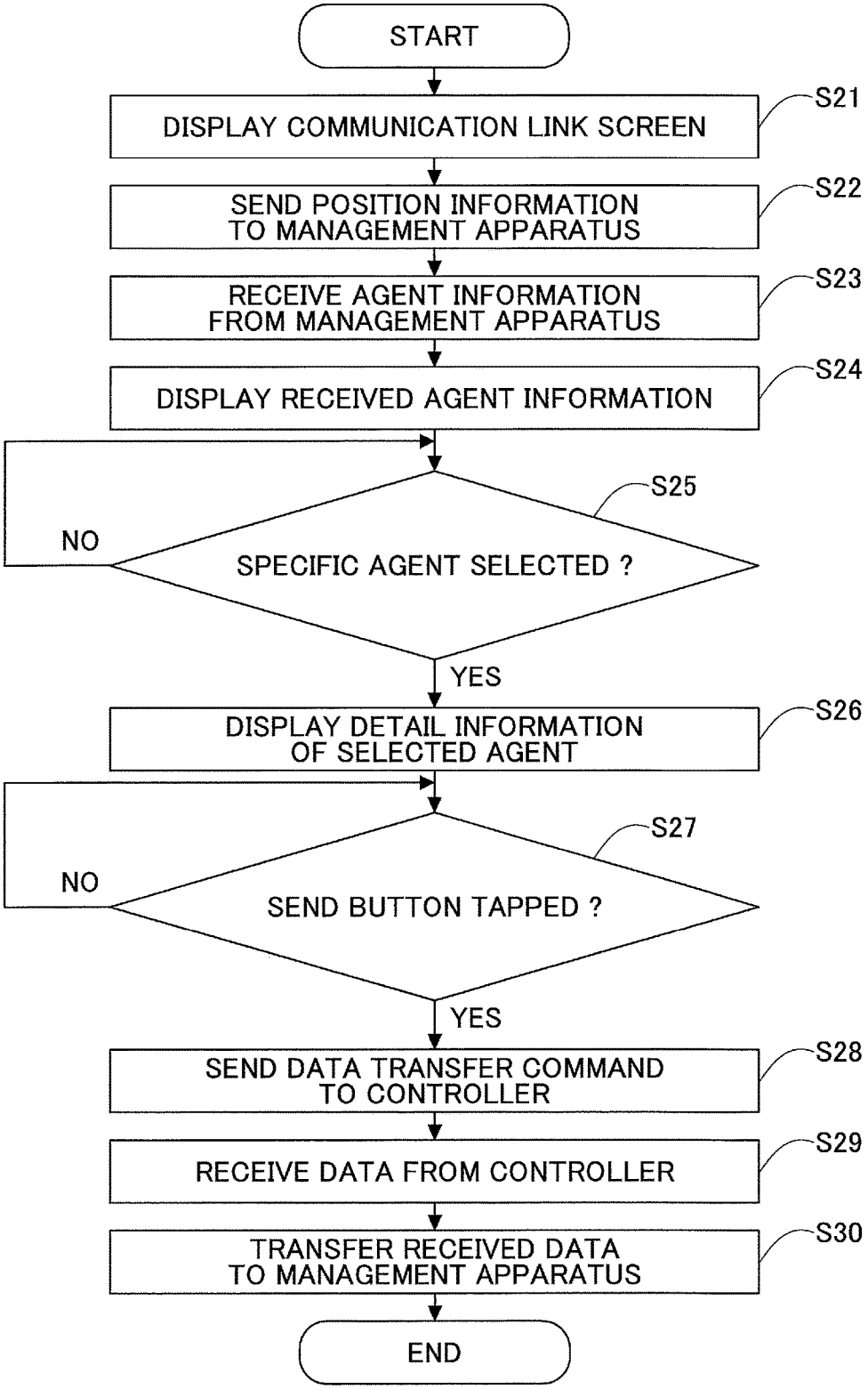
FIG. 15 is a flowchart of a shovel abnormal time process.
Figure 16:
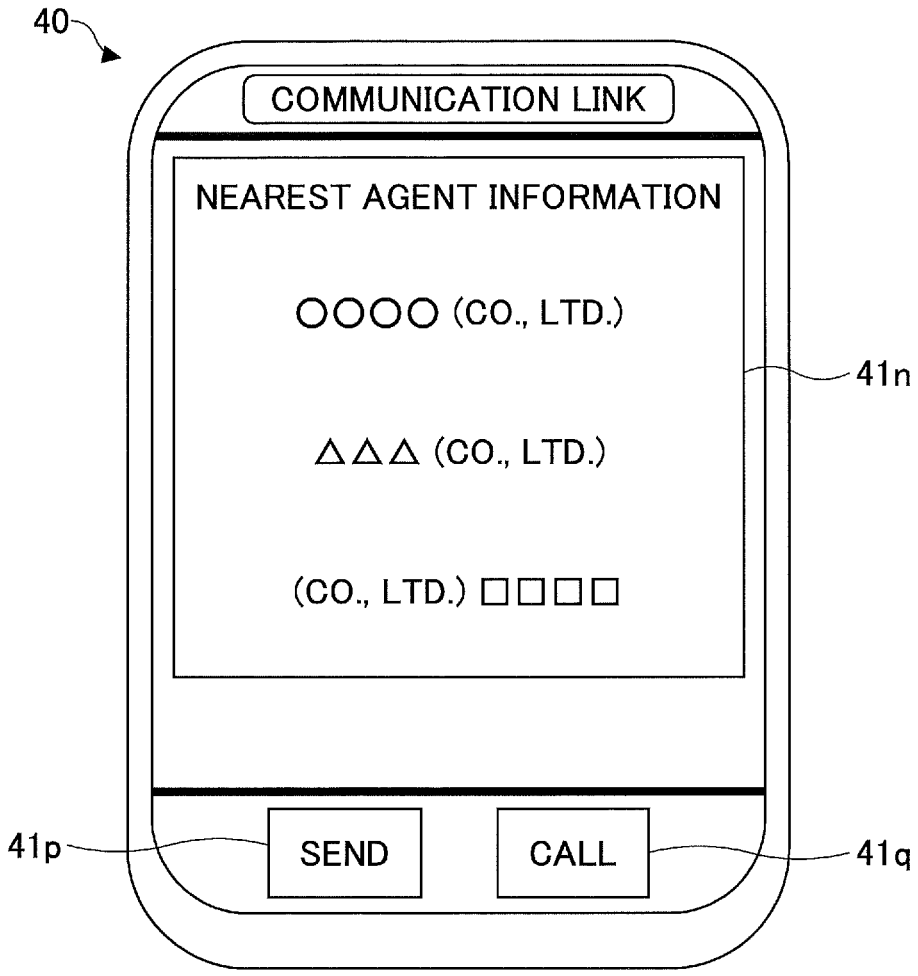
FIG. 16 is an illustration of an example of a communication link screen.
Figure 17:
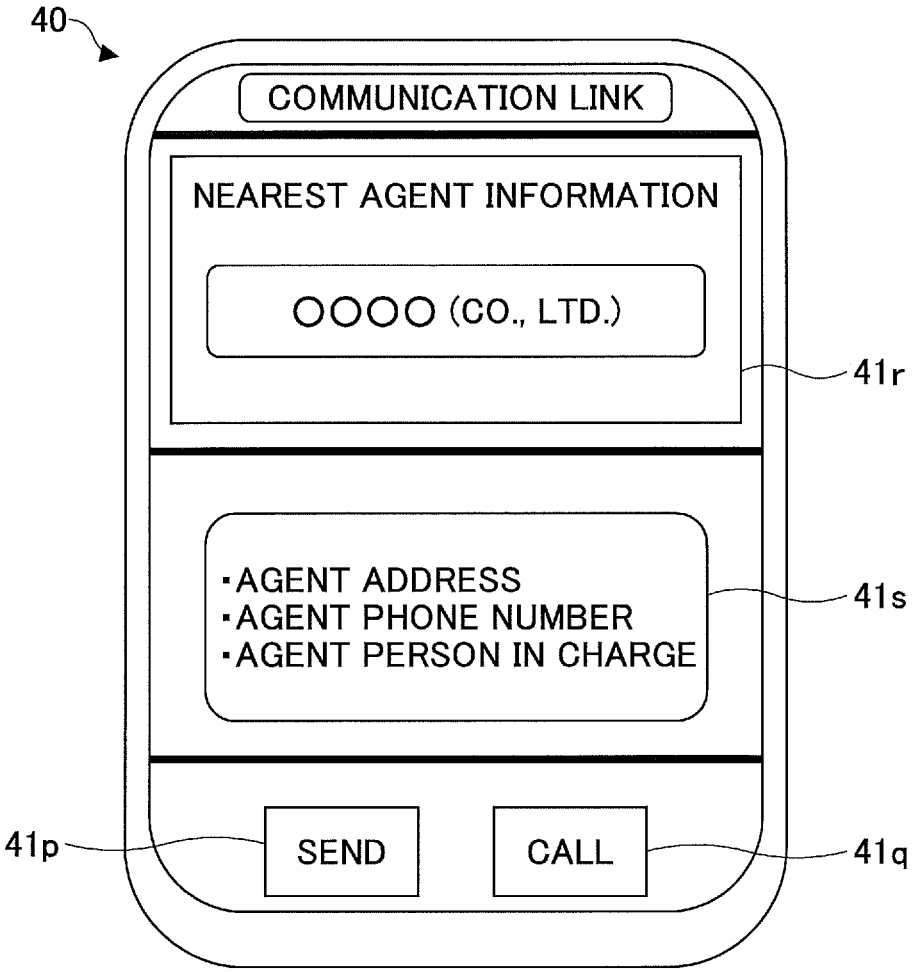
FIG. 17 is an illustration of another example of the communication link screen.

Next, a description is given, with reference to FIG. 15 through FIG. 17, of a process performed in the multifunctional portable information terminal 40 (hereinafter, referred to as the "shovel abnormal time process") when an abnormality of the shovel is detected. FIG. 15 is a flowchart indicating a flow of the shovel abnormality time process. FIG. 16 and FIG. 17 are examples of a screen that displays various kinds of information acquired through a communication with the management apparatus 90 (hereinafter, referred to as the "communication link screen"). Additionally, the multifunctional portable information terminal 40 performs the shovel abnormal time process when an abnormality of the shovel is detected based on a notification from the controller 30.

First, the multifunctional portable information terminal 40 displays the communication link screen (step S21). In the present embodiment, the communication link screen includes, as illustrated in FIG. 13, an agent information display part 41*n*, send button 41*p* and call button 41*q*. The agent information display part 41*n* is an area for displaying information regarding a contact address at the time of abnormality in the shovel. The send button 41*p* and call button 41*q* are software buttons displayed on the display and input device 40*c*. When the send button 41*p* is tapped, the multifunctional portable information terminal 40 sends the data stored in a predetermined area in the controller 30. When the call button 41*q* is tapped, the multifunctional portable information terminal 40 makes a call to the contact address, which is in a selected state on the display and input device 40*c*.

Thereafter, the multifunctional portable information terminal 40 sends position information of its own to the management apparatus 90 (step S22). In the present embodiment, the multifunctional portable information terminal 40 sends position information acquired using the GPS function to the management apparatus 90. The management apparatus 90 creates agent information by searching information regarding an agent existing within a predetermined distance range from the present position of the multifunctional portable information terminal 40 based on the position information received from the multifunctional portable information terminal 40. Then, the management apparatus 90 sends the created agent information to the multifunctional portable information terminal 40.

Thereafter, the multifunctional portable information terminal 40 receives the agent information from the management apparatus 90 (step S23), and displays the received agent information on the agent information display part 41*n* of the communication link screen (step S24). FIG. 16 illustrates a state where three agents are retrieved as a nearest agent.

Thereafter, the multifunctional portable information terminal 40 determines whether a specific agent is selected (step S25). In the present embodiment, the multifunctional portable information terminal 40 determines whether any one of the areas corresponding to the respective three agents in the agent information display part 41*n* is tapped by the driver.

If it is determined that a specific agent is not selected yet (NO in step S25), the multifunction portable information terminal 40 waits until a specific agent is selected.

If it is determined that a specific agent is selected (YES in step S25), the multifunction portable information terminal 40 displays the selected agent and detail information of the selected agent on the display and input device 40*c* (step S26). In the present embodiment, the multifunction portable information terminal 40 displays the communication link screen containing a selected agent display part 41*r*, which displays the selected specific agent, and a detail information display part 41*r*, which displays information of details of the selected specific agent. FIG. 17 illustrates a state where a specific agent is selected and information of details of the selected agent is displayed.

Thereafter, the multifunction portable information terminal 40 determines whether the sending button 41*p* is tapped (step S27).

Then, if it is determined that the send button 41*p* is not tapped (NO in step S27), the multifunction portable information terminal 40 waits until the send button 41*p* is tapped.

On the other hand, if it is determined that the send button 41*p* is tapped (YES in step S27), the multifunction portable information terminal 40 sends a data transfer command to the controller 30 (step S28). In the present embodiment, upon reception of the data transfer command, the controller 30 sends data, which is stored in a predetermined area such as the temporary storing part 30*a*, the abnormality information storing part, etc., to the multifunction portable information terminal 40.

Thereafter, the multifunction portable information terminal 40 receives the data sent from the controller 30 (step S29), and transfers the received data to the management apparatus 90 (step S30).

If the call button 41*q* is tapped, the multifunction portable information terminal 40 dials the telephone number of the agent that is set in a selected state.

As mentioned above, the multifunction portable information terminal 40 automatically displays the communication link screen when an abnormality is detected in the shovel so that the driver can easily take measures such as a contact to the agent.

Figure 18:
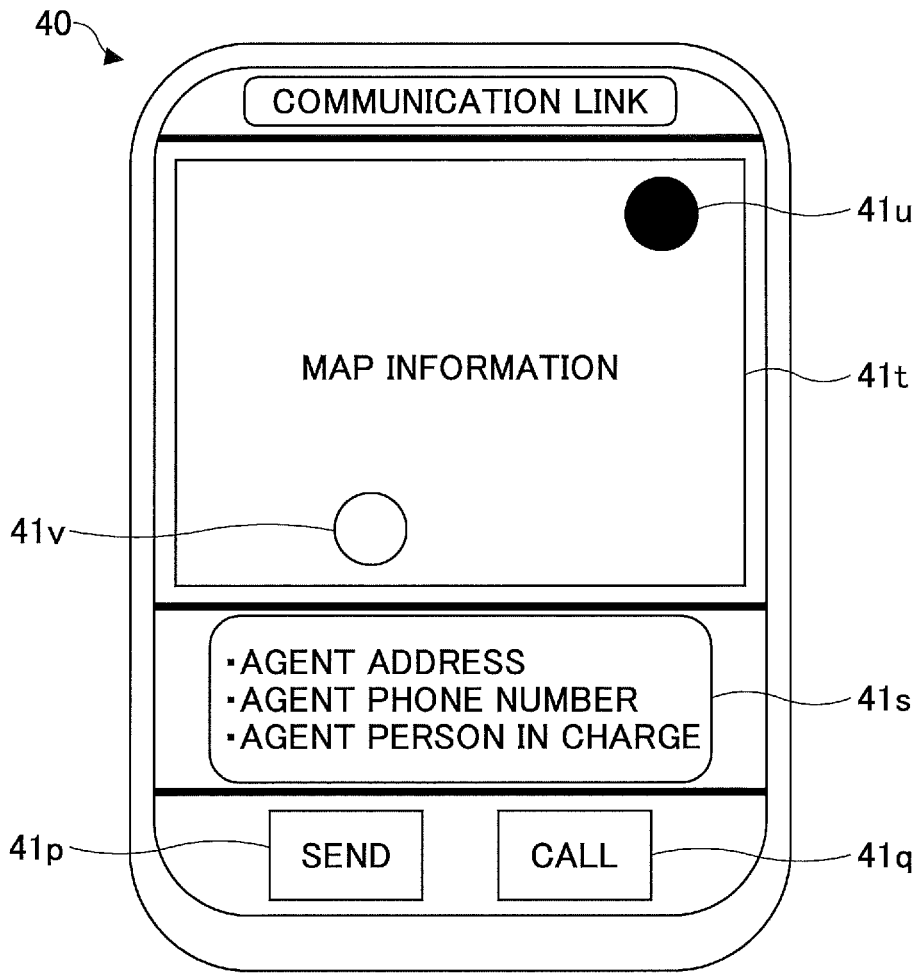
FIG. 18 is an illustration of a further example of the communication screen.

Next, a description is given, with reference to FIG. 18, of another example of the communication link screen displayed on the display and input device 41*c* when performing the shovel abnormality time process. The communication link screen illustrated in FIG. 15 includes the send button 41*p*, call button 41*q*, detail information display part 41*s* and a map display part 41*t*.

In the present embodiment, the multifunction portable information terminal 40 receives agent information from the management apparatus 90, and displays the communication link screen on the display and input device 40*c* after a specific agent is selected. Note that the multifunction portable information terminal 40 may display the communication link screen before a specific agent is selected.

The map display part 41*t* is a part for displaying map information, and includes a present position icon 41*u*, which indicates a present position of the shovel (the multifunction portable information terminal 40), and an agent position icon 41*v*, which indicates a position of the retrieved or selected agent.

The driver can perform scrolling, reducing and enlarging of map information on the map display part 41*t* using a swipe operation, pinch-in operation, pinch-out operation, etc., on the multifunction portable information terminal 40.

As mentioned above, the multifunction portable information terminal 40 displays the map information when an abnormality is detected in the shovel so that the driver can easily recognize a positional relationship between the shovel and the agent. Additionally, the multifunction portable information terminal 40 makes an exclusive communication controller, which is to be attached to the shovel, unnecessary so as to attempt a cost reduction of the shovel. Moreover, the vibration measuring function provided in the multifunction portable information terminal 40 can be used in a failure analysis of components constituting the shovel. Furthermore, the orientation determining function provided in the multifunction portable information terminal 40 can be used when displaying an orientation of the shovel on the map display part 41*t*.

Figure 19:
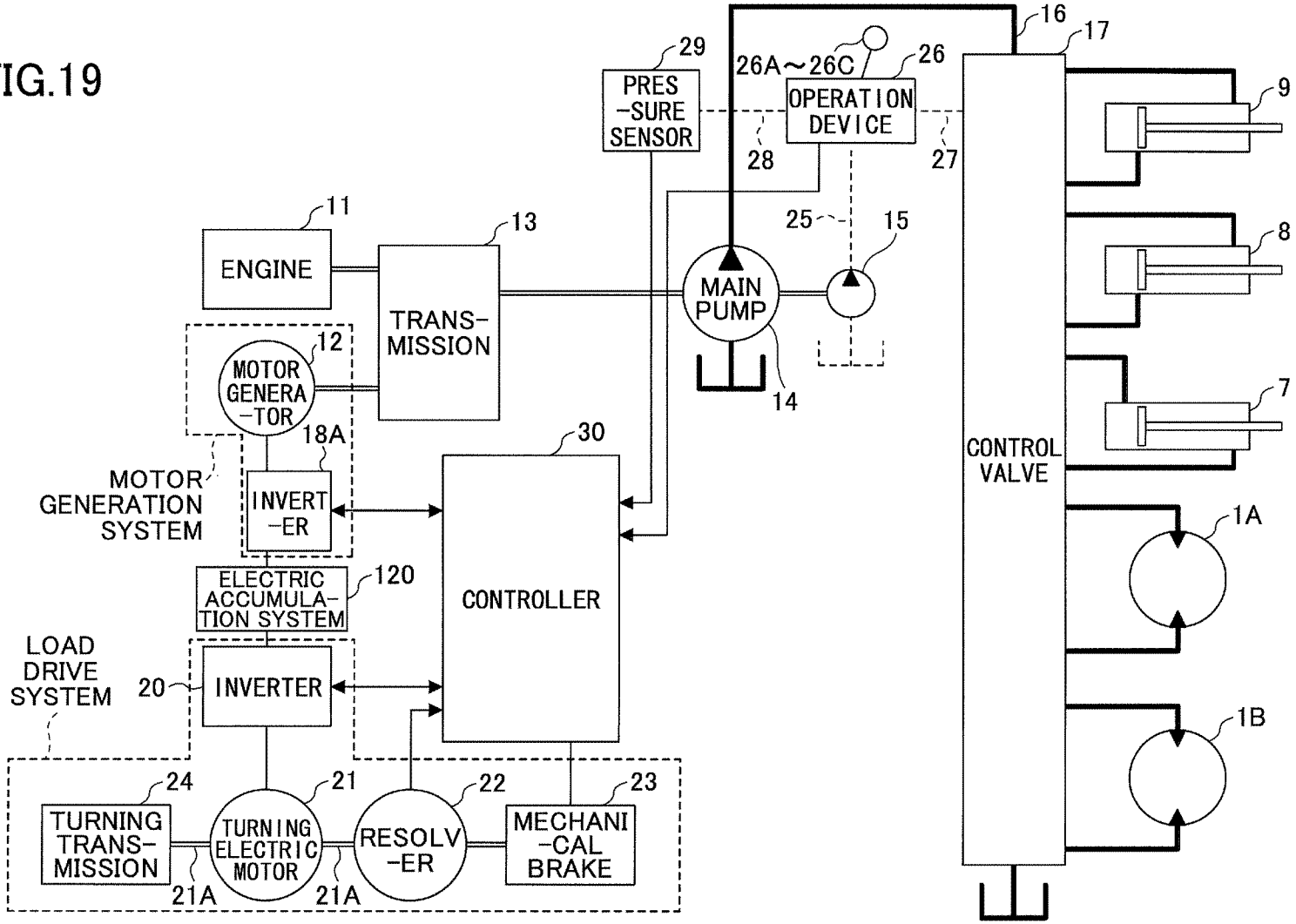
FIG. 19 is a block diagram of a drive system of a hybrid shovel according to an embodiment of the present invention.

Although the management apparatus is mounted to the shovel in the above-mentioned embodiments, the management apparatus may be mounted to a hybrid shovel having a structure illustrated in FIG. 19. A description is given below of a structure of a hybrid shovel. In FIG. 19, double lines denote a mechanical power system, bold solid lines denote high-pressure hydraulic lines, dashed thin lines denote pilot lines, and thin solid lines denotes an electric drive/control system.

An engine 11 as a mechanical drive part and a motor generator 12 as an assist drive part are connected to two input axes of a transmission 13, respectively. A main pump 14 and pilot pump 15 as hydraulic pumps are connected to an output axis of the transmission 13. A control valve 17 is connected to the main pump 14 via a high-pressure hydraulic line 16.

The control valve 17 is a control device for controlling the hydraulic system in the hybrid shovel. Hydraulic motors 1A (right) and 1B (left) for the lower running body 1, a boom cylinder 7, an arm cylinder 8 and a bucket cylinder 9 are connected to the control valve 17 via the high-pressure hydraulic lines.

An electric accumulation system 120 including a capacitor as an electric accumulator is connected to the motor generator via an inverter 18A. A turning electric motor 21 as an electric operating element is connected to the electric accumulation system via an inverter 20. A resolver 22, mechanical brake 23 and turning transmission 24 are connected to a rotation axis 21A of a turning electric motor 21. An operation device 26 is connected to the pilot pump 15 via a pilot line 25. The turning electric motor 21, inverter 20, resolver 22, mechanical brake 23 and turning transmission 24 together constitute a load drive system.

The operation device 26 includes a lever 26A, lever 26B and pedal 26C. The lever 26A, lever 26B and pedal 26C are connected to the control valve 17 and the pressure sensor 29 via hydraulic lines 27 and 28, respectively. The pressure sensor 29 is connected to the controller 30, which performs a drive control for an electric system.

The controller 30 is a control device as a main control part for performing a drive control for the hybrid shovel. The controller 30 is constituted by an operation processing device including a CPU (Central Processing Unit) and an internal memory, and is a device materialized by the CPU executing a drive control program stored in the internal memory.

The controller 30 converts a signal supplied from the pressure sensor 29 into a speed command to perform the drive control on the turning electric motor 21. The signal supplied from the pressure sensor 29 corresponds to a signal representing an amount of operation when the operation device 26 is operated to turn a turning mechanism 2.

The controller 30 performs a drive control of the motor generator 12 (switching between an electric drive (assist) operation and a generating operation), and also performs a charge and discharge control of the capacitor as an electric accumulation part of the electric accumulation system 120 by drive-controlling a voltage up and down converter of the electric accumulation system 120. The controller 30 performs a switching control between an voltage-up operation and a voltage-down operation of the voltage up and down converter based on a charge state of the capacitor, a drive state of the motor generator 12 (an electric drive (assist) operation or a generating operation) and a drive state of the turning electric motor 21 (a power running operation or a regenerative operation), and, thereby, performing a charge and discharge control of the capacitor.

The present invention is not limited to the specifically disclosed embodiments using the above-mentioned shovel as an example, and various variations and modifications may be made without departing from the scope of the present invention.

What is claimed is:

1. A shovel management system, comprising:

a shovel management apparatus, the shovel management apparatus including a processor; and a memory storing a program that, when executed by the processor, causes the shovel management apparatus to temporarily store detection information in a first part of the memory, the detection information containing an amount of an operation of a lever of a shovel detected in the shovel and physical amounts detected by a plurality of sensors in the shovel;

perform an abnormality determination based on the detection information, and cause, when an occurrence of an abnormality is determined at a first time, the detection information stored in the first part of the memory over a time period from a second time earlier than the first time to at least the first time to be transferred from the first part of the memory to a second part of the memory to be stored in the second part of the memory as abnormality information; and wirelessly transmit the detection information stored in the second part of the memory; and a portable information terminal configured to wirelessly receive the transmitted detection information, and display, as the abnormality information, at least the amount of the operation of the lever and the physical amounts included in the received detection information in a time chart on a single screen.

2. The shovel management system as claimed in claim 1, wherein, when executed by the processor, the program further causes the shovel management apparatus to cause the portable information terminal to wirelessly transmit the detection information stored in the second part of the memory to an apparatus external to the shovel management system.

3. The shovel management system as claimed in claim 1, wherein, when executed by the processor, the program causes the shovel management apparatus to cause the detection information stored in the first part of the memory over a time period from the second time earlier than the first time to a third time later than the first time to be transferred from the first part of the memory to the second part of the memory to be stored in the second part of the memory as the abnormality information.

4. The shovel management system as claimed in claim 1, wherein the portable information terminal is configured to display a time designating part to designate a time, and values of the physical amounts at the time designated by the time designating part is displayed on the portable information terminal.

5. The shovel management system as claimed in claim 1, wherein the displayed physical amounts include temperature-related information related to at least one of engine water temperature and operating oil temperature of the shovel, and load-related information related to at least one of an engine injection pressure and a pump pressure of the shovel.

6. The shovel management system as claimed in claim 1, wherein the displayed physical amounts include information related to at least one of an engine revolution number, an engine boost pressure, an engine load rate, an engine injection pressure, and a pump pressure of the shovel.

7. A shovel management apparatus, comprising:

a processor; and a memory storing a program that, when executed by the processor, causes the shovel management apparatus to performs perform an abnormality determination based on detection information containing an amount of an operation of a lever of a shovel detected in the shovel and physical amounts detected by a plurality of sensors in said shovel, and store, when an occurrence of an abnormality is determined at a first time, the detection information created in a time period from a second time earlier than the first time to at least the first time in the memory as abnormality information; and display, as the abnormality information, at least the amount of the lever operation and the physical amounts included in the detection information stored in the memory in a time chart on a single screen of a display device.

8. The shovel management apparatus as claimed in claim 7, wherein, when executed by the processor, the program causes the shovel management apparatus to store the detection information generated in a time period from the second time earlier than the first time to a third time later than the first time in the memory as the abnormality information.

9. The shovel management apparatus as claimed in claim 7, wherein, when executed by the processor, the program causes the shovel management apparatus to display at least the amount of the operation of the lever and the physical amounts as waveform information by relating the amount of the operation of the lever and the physical amounts to a predetermined time interval, and display a time designating part to designate a time, and values of the physical amounts at the time designated by the time designating part.

10. A shovel management apparatus comprising:

a processor; and a memory storing a program that, when executed by the processor, causes the shovel management apparatus to display, as abnormality information, at least an amount of an operation of a lever of a shovel detected in the shovel and physical amounts detected by a plurality of sensors in said shovel in a time chart on a single screen of a display device, the amount of the operation of the lever and the physical amounts being included in detection information generated in a time period from a first time earlier than an abnormality determining time at which an occurrence of an abnormality is determined to at least the abnormality determining time.

11. The shovel management apparatus as claimed in claim 10, wherein, when executed by the processor, the program causes the shovel management apparatus to display, when an occurrence of an abnormality is determined at the abnormality determining time, the detection information generated in a time period from the first time earlier than the abnormality determining time to a second time later than the abnormality determining time.

12. The shovel management apparatus as claimed in claim 10, wherein, when executed by the processor, the program causes the shovel management apparatus to display the detection information as waveform information by relating the amount of the operation of the lever and the physical amounts to a predetermined time interval, and also display a time designating part to designate a time and values of the physical amounts at the time designated by the time designating part.

13. The shovel management apparatus as claimed in claim 10, wherein, when executed by the processor, the program causes the shovel management apparatus to display a diagnosis flow screen corresponding to the abnormality information.

14. A shovel management method executed in a shovel management apparatus including a processor and a memory storing a program that, when executed by the processor, causes the shovel management apparatus to execute processes of the shovel management method, the shovel management method comprising:

temporarily storing detection information in a first part of the memory, the detection information containing an amount of an operation of a lever of a shovel detected in the shovel and physical amounts detected by a plurality of sensors in the shovel;

performing an abnormality determination based on the detection information;

retrieving, when an occurrence of an abnormality is determined in said performing the abnormality determination, the detection information from the first part of the memory, and storing the retrieved detection information in a second part of the memory; and displaying at least the amount of the operation of the lever and the physical amounts included in the retrieved detection information in a time chart on a single screen of a display device.

15. A shovel management method, executed in a shovel management apparatus including a processor and a memory storing a program that, when executed by the processor, causes the shovel management apparatus to execute processes of the shovel management method, the shovel management method comprising:

acquiring detection information containing an amount of an operation of a lever of a shovel detected in the shovel and physical amounts detected by a plurality of sensors in the shovel; and displaying, in a time chart on a single screen of a display device, at least the amount of the operation of the lever and the physical amounts included in a part of the detection information generated in a time period from a first time earlier than an abnormality determining time at which an occurrence of an abnormality in said shovel is determined to at least the abnormality determining time.

* * * * *